US010442233B2

(12) United States Patent
Costin, Jr. et al.

(10) Patent No.: US 10,442,233 B2
(45) Date of Patent: Oct. 15, 2019

(54) SYSTEM AND METHOD OF GENERATING A PATTERN USED TO PROCESS A SURFACE OF A FABRIC THROUGH LASER IRRADIATION, AND FABRIC CREATED THEREBY

(71) Applicant: REVOLAZE, LLC, Westlake, OH (US)

(72) Inventors: Darryl J. Costin, Jr., Avon, OH (US); Heath Colwell, Westlake, OH (US)

(73) Assignee: RevoLaze, LLC, Westlake, OH (US)

( * ) Notice: Subject to any disclaimer, the term of this patent is extended or adjusted under 35 U.S.C. 154(b) by 635 days.

(21) Appl. No.: 15/074,574

(22) Filed: Mar. 18, 2016

(65) Prior Publication Data

US 2016/0263928 A1 Sep. 15, 2016

Related U.S. Application Data

(63) Continuation-in-part of application No. 14/491,597, filed on Sep. 19, 2014.

(60) Provisional application No. 61/930,082, filed on Jan. 22, 2014, provisional application No. 61/879,844, filed on Sep. 19, 2013.

(51) Int. Cl.

| | |
|---|---|
| ***B41M 7/00*** | (2006.01) |
| ***B41J 2/455*** | (2006.01) |
| ***D06P 5/13*** | (2006.01) |
| ***D06P 5/15*** | (2006.01) |
| ***D06P 5/20*** | (2006.01) |
| ***D06Q 1/02*** | (2006.01) |
| ***D06B 11/00*** | (2006.01) |
| ***D06C 23/02*** | (2006.01) |

(52) U.S. Cl.

CPC ..... *B41M 7/0009* (2013.01); *B41J 2/455* (2013.01); *D06B 11/0096* (2013.01); *D06C 23/02* (2013.01); *D06P 5/13* (2013.01); *D06P 5/15* (2013.01); *D06P 5/2005* (2013.01); *D06Q 1/02* (2013.01); *Y10T 428/2481* (2015.01)

(58) Field of Classification Search

CPC ..... B41M 7/0009; B41J 2/455; D06P 5/13; D06P 5/15; D06P 5/2005; D06Q 1/02; D06B 11/0096; D06C 23/02; Y10T 428/2481

USPC ..... 442/181

See application file for complete search history.

(56) References Cited

U.S. PATENT DOCUMENTS

| | | | |
|---|---|---|---|
| 5,200,592 | A | 4/1993 | Yabu |
| 5,567,207 | A | 10/1996 | Lockman et al. |
| 5,916,461 | A | 6/1999 | Costin et al. |

(Continued)

FOREIGN PATENT DOCUMENTS

| | | | |
|---|---|---|---|
| GB | 2294656 | A | 5/1996 |

*Primary Examiner* — Cephia D Toomer

(74) *Attorney, Agent, or Firm* — Berenato & White, LLC

(57) ABSTRACT

A method is provided of generating a pattern image used to form a pattern on a surface of a fabric using laser irradiation. A plurality of parameters associated with laser irradiation units are input into a user interface. The parameters include an area parameter, a laser irradiation unit density parameter, optionally a discontinuity parameter, and a dye removal parameter. A plurality of laser irradiation units arranged in a pattern area of a user interface based on computer processing of the inputted plurality of parameters is received for viewing at the user interface. The laser irradiation units collectively establish the pattern image for viewing by the user.

22 Claims, 34 Drawing Sheets

(56) References Cited

U.S. PATENT DOCUMENTS

| | | | | |
|---|---|---|---|---|
| 5,990,444 | A | 11/1999 | Costin | |
| 6,002,099 | A | 12/1999 | Martin et al. | |
| 6,495,237 | B1 | 12/2002 | Costin | |
| 6,528,758 | B2 | 3/2003 | Shaffer | |
| 6,616,710 | B1 | 9/2003 | Costin et al. | |
| 6,664,505 | B2 | 12/2003 | Martin | |
| 6,807,456 | B1 | 10/2004 | Costin, Jr. et al. | |
| 6,819,972 | B1 * | 11/2004 | Martin ..... | D06B 11/0096 219/121.68 |
| 6,858,815 | B1 | 2/2005 | Costin | |
| 2001/0025835 | A1 | 10/2001 | Costin, Jr. | |
| 2015/0079359 | A1 | 3/2015 | Costin, Jr. | |

* cited by examiner

SYSTEM AND METHOD OF GENERATING A PATTERN USED TO PROCESS A SURFACE OF A FABRIC THROUGH LASER IRRADIATION, AND FABRIC CREATED THEREBY

CROSS-REFERENCE TO RELATED APPLICATION(S)

This application is a continuation-in-part of U.S. application Ser. No. 14/491,597 filed on Sep. 19, 2014, which claims the benefit of priority of U.S. Provisional Application No. 61/879,844 filed Sep. 19, 2013 and U.S. Provisional Application No. 61/930,082 filed Jan. 22, 2014, the priorities of which are claimed herein.

BACKGROUND OF THE INVENTION

Field of the Invention

The present invention generally relates to surface treatment of fabrics with one or more lasers and, more specifically, to a system and method for generating a pattern image used to process a surface of a fabric through laser irradiation (lasing), to the overall lasing process, and to the fabric resulting from such treatment having a pattern corresponding to the pattern image. In certain embodiments of the invention, processing of the fabric may be accomplished through the use of either multiple passes of a single laser or multiple lasers each lasing an individual pass or multiple passes.

Description of the Related Art

Fabric, such as denim, can be processed to simulate a worn look. Conventionally, a wet process such as a stone and/or enzyme process is applied to the fabric, typically after the fabric has been transformed into a garment, to create a faded and worn look. Specifically, an enzyme wash in combination with an agitation element, such as stones or rocks, removes color from a ridged blue denim fabric to develop a contrasting pattern of variable color intensities creating a stonewashed look. The faded areas of the denim fabric can correspond to where stones or rocks contact the fabric during the enzyme washing process.

However, traditional stonewash and/or enzyme processes have numerous drawbacks. For example, each manufacturing cycle requires extensive time to create the stonewashed look. Further, a significant amount of water is used during the stonewash and enzyme processes. In addition, the handling and disposal of the enzymes and wastewater can require substantial attention to comply with environmental regulations.

Ring spun denim is a type of fabric that is processed into garments. Ring spun denim is a strong, durable fabric that includes imperfections, known as slubs. These imperfections (slubs) create a unique vintage quality look. In addition, ring spun denim has a more luxurious texture because more cotton fibers are used to create the yarn for ring spun fabric than conventional denim fabric. Due to the characteristics of the yarn, ring spun fabric tends to fade more evenly, contributing to a more authentic vintage look. However, ring spun denim is more costly than standard denim fabric due to the higher fiber count and relative inefficiencies in manufacturing the ring spun denim product.

Lasers have been proposed to process graphics and patterns onto a surface of a fabric, including denim, thereby creating different looks, including denim looks, using a dry process. However, re-creating an enzyme-wash look or stonewash look using laser processing techniques is difficult due to the unique characteristics created during enzyme washes and stonewashes, where each garment or fabric piece differs from the other. Specifically, previous lasing methods implemented uniform, repeating patterns that might not adequately capture the contrast in color intensities to create aesthetically pleasing enzyme and stonewash patterns.

U.S. Pat. Nos. 6,495,237 and 6,616,710 disclose methods and systems for laser irradiating various substrates in order to apply a graphic to the surface. Specifically, the '710 patent discloses use of a laser to simulate an enzyme wash and the '237 patent discloses methods to create a stone wash image.

An object of the invention is to provide a method and system for generating a pattern image used to process a surface of a fabric through laser irradiation that improves upon prior pattern generation methods and systems.

SUMMARY OF THE INVENTION

An aspect of the invention provides a method of generating a pattern image on a pattern area of a user interface, the pattern area including an array of pixels, the pattern image being useful to form a corresponding lased pattern on a surface of a fabric by application of laser irradiation. The method involves inputting a plurality of parameters associated with laser irradiation units into the user interface, and viewing laser irradiation units arranged in the pattern area of the user interface based on computer processing of the inputted plurality of parameters, the laser irradiation units collectively establishing the pattern image for viewing. The plurality of parameters include an area parameter including a width and a length that is greater than the width, a laser irradiation unit density parameter, a discontinuity parameter, and a dye removal parameter. The discontinuity parameter includes a skip between the laser irradiation units, a gap within the laser irradiation units, and/or a laser frequency effective for generating discontinuities in the pattern lased onto the surface of the fabric. The dye removal parameter represents an amount of dye to be removed from the fabric, the amount of dye to be removed being subject to user-preselected laser operational settings.

According to another aspect of the invention, a system is provided for generating a pattern image useful to lase a surface of a fabric using laser irradiation. The system includes a pattern generating device configured to receive a plurality of parameters associated with laser irradiation units inputted into a user interface, and to arrange the laser irradiation units in the pattern area of the user interface based on computer processing of the inputted plurality of parameters, the laser irradiation units collectively establishing the pattern image for viewing of a pattern to be lased onto the surface of the fabric. The plurality of parameters include an area parameter including a width and a length that is greater than the width, a laser irradiation unit density parameter, a discontinuity parameter, and a dye removal parameter. The discontinuity parameter includes a skip between the laser irradiation units, a gap within the laser irradiation units, and/or a laser frequency effective for generating discontinuities in the pattern lased onto surface of the fabric. The dye removal parameter represents an amount of dye to be removed from the fabric, the amount of dye to be removed being subject to user-preselected laser operational settings.

Yet another aspect of the invention provides a method of generating a pattern image on a pattern area at a user interface, the pattern area including an array of pixels, the pattern image being useful to form a corresponding lased pattern on a surface of a fabric by application of laser irradiation. The method includes inputting a plurality of parameters associated with laser irradiation units into the user interface, and viewing the laser irradiation units arranged in the pattern area of the user interface based on computer processing of the inputted plurality of parameters, the laser irradiation units collectively establishing the pattern image for viewing. The plurality of parameters include an area parameter including a width of at least one pixel and a length of at least one pixel, a laser irradiation unit density parameter, and a dye removal parameter representing an amount of dye to be removed from the fabric, the amount of dye to be removed being subject to user-preselected laser operational settings.

Still another aspect of the invention provides a system for generating a pattern image used to lase a surface of a fabric by application of laser irradiation. The system includes a pattern generating device configured to receive a plurality of parameters associated with laser irradiation units inputted into a user interface, and arrange the laser irradiation units in the pattern area of the user interface based on computer processing of the inputted plurality of parameters, the laser irradiation units collectively establishing the pattern image to be lased on the surface of the fabric. The plurality of parameters include an area parameter including a width of at least one pixel and a length of at least one pixel, a laser irradiation unit density parameter, and a dye removal parameter representing an amount of dye to be removed from the fabric, the amount of dye to be removed being subject to user-preselected laser operational settings.

Other aspects of the invention, including apparatus, devices, systems, fabrics, non-transitory computer/machine readable media processes, and the like which constitute part of the invention, will become more apparent upon reading the following detailed description of the exemplary embodiments.

BRIEF DESCRIPTION OF THE DRAWINGS

The accompanying drawings are incorporated in and constitute a part of the specification. The drawings, together with the general description given above and the detailed description of the exemplary embodiments and methods given below, serve to explain the principles of the invention. The objects and advantages of the invention will become apparent from a study of the following specification when viewed in light of the accompanying drawings, in which like elements are given the same or analogous reference numerals and wherein.

DETAILED DESCRIPTION OF EXEMPLARY EMBODIMENTS

Figure 1:
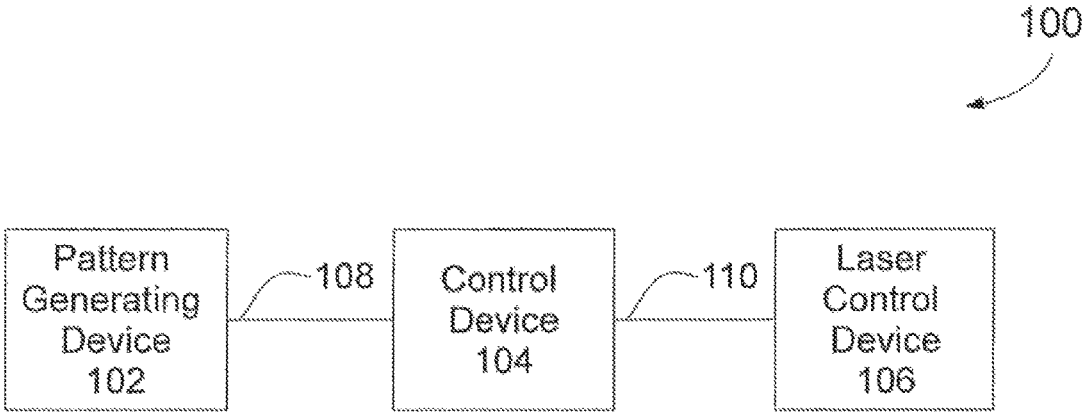
FIG. 1 illustrates a block diagram of a laser processing system for processing a surface of a fabric according to an exemplary embodiment.

Reference will now be made in detail to exemplary embodiments and methods of the invention as illustrated in the accompanying drawings, in which like reference characters designate like or corresponding parts throughout the drawings. It should be noted, however, that the invention in its broader aspects is not limited to the specific details, representative devices and methods, and illustrative examples shown and described in connection with the exemplary embodiments and methods.

This description of exemplary embodiments is intended to be read in connection with the accompanying drawings, which are to be considered part of the entire written description. In the description, relative terms such as "horizontal," "vertical," "up," "down," "upper," "lower," "right," "left," "top," and "bottom" as well as derivatives thereof (e.g., "horizontally," "downwardly," "upwardly," etc.) should be construed to refer to the orientation as then described or as shown in the drawing figure under discussion. These relative terms are for convenience of description and normally are not intended to require a particular orientation. Terms concerning attachments, coupling and the like, such as "connected" and "interconnected," refer to a relationship wherein structures are secured or attached to one another either directly or indirectly through intervening structures, as well as both movable or rigid attachments or relationships, unless expressly described otherwise. The term "operatively connected" is such an attachment, coupling or connection that allows the pertinent structures to operate as intended by virtue of that relationship. Additionally, the words "a" and "an" as used in the claims mean "at least one" and the word "two" as used in the claims means "at least two".

FIG. 1 illustrates a block diagram of a laser processing system for processing a surface of a fabric according to an exemplary embodiment of the present invention. The laser processing system 100 includes a pattern generating device 102, a control device 104, and a laser control system 106.

Figure 23:
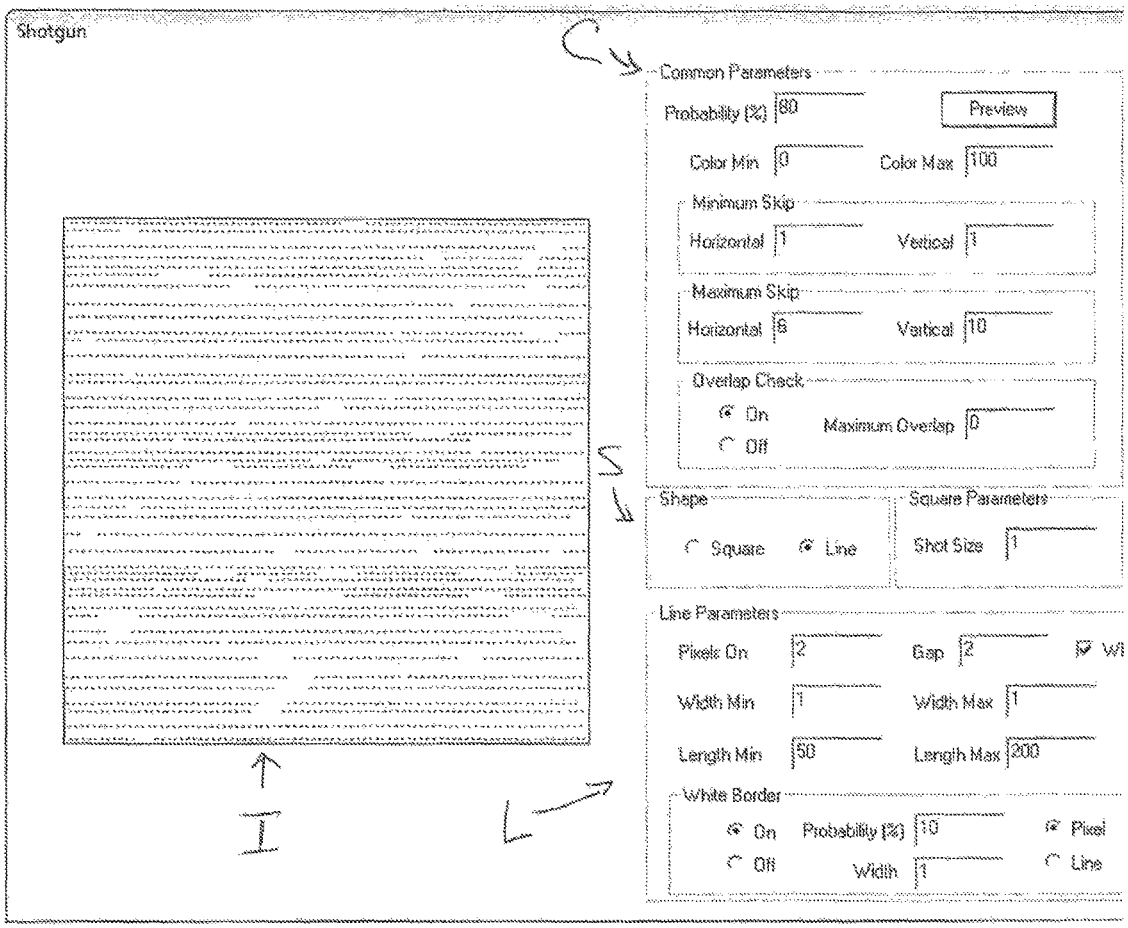
FIG. 23 illustrates an exemplary parameter interface or pattern generation interface according to an exemplary embodiment.

The pattern generating device 102 is configured to generate a pattern to process a surface of a fabric through laser irradiation. For example, a user can interact with pattern generating device 102 using a pattern generation interface (an example of which is shown in FIG. 23, discussed below). The pattern generation interface may be associated with various software applications such as TechnoBlast™ available from Technolines, LLC. or ADOBE PHOTOSHOP® with the use of Revolaze plug-in concepts. A pattern area can be defined within the pattern generation interface where a pattern image to process on a surface of a fabric through laser irradiation is generated within the pattern area. Various pattern images can be created within the pattern area. For example, a pattern image to re-create a stonewash or enzyme pattern, a pattern image to re-create a ring spun pattern, or a pattern image to re-create combinations of stonewash/enzyme and ring spun patterns can be generated using the pattern generation interface. This plurality of patterns could be processed as a single source file, as well as a single pass of laser irradiation, or multiple source files and multiple passes of laser irradiation upon the substrate.

The pattern generating device 102 includes a processor and associated circuitry to execute or direct the execution of machine-readable (such as computer-readable) instructions to obtain, process, and generate information relating to the pattern image. The pattern generating device 102 retrieves and executes software from storage, which can include a disk drive, a flash drive, memory circuitry, or some other memory device, server, or other storage device, and which storage can be local or remotely accessible. The software includes computer programs, firmware, and/or or other forms of machine-readable instructions, and may include an operating system, utilities, drivers, network interfaces, applications, software, or the like, including combinations thereof. ADOBE PHOTOSHOP® is a commercially available program that may be used and customized to practice the invention, e.g., see FIG. 23. However, one of ordinary skill in the art reviewing this specification will recognize that other image generation software capable of carrying out the pattern-creation process described herein may be used. The pattern generating device 102 can receive instructions and other input information at a user (pattern generation) interface.

In an exemplary embodiment, the user (pattern generation) interface of the pattern generating device 102 can include various peripherals such as a display, a keyboard, a mouse, a printer, a scanner, etc., where at least one of the peripherals can be used to input parameters associated with generating a pattern image that is processed to form a corresponding pattern onto a surface of a fabric through lasing (also referred to herein as laser irradiation). Preferably, a display is provided as a peripheral and the user commences pattern image creation with a blank or white screen as a starting image to be transformed into the pattern image.

The pattern image can be generated a first time using the tools described herein to create (first) pattern laser irradiation units on the pattern generation interface. However, creation of the pattern image can be an iterative process. For example, a pattern image can be generated, the fabric can be processed through laser irradiation (lasing) to form a pattern corresponding to the pattern image onto the surface of the fabric, and the resulting fabric can be examined to determine whether the lased pattern created an appropriate aesthetic look. If desired, post-lasing processing of the resulting fabric can be carried out, such as enzyme washing. Lasing reduces the amount of enzyme washing that would otherwise be required to obtain the desired aesthetic look. When the resulting processed fabric does not achieve the appropriate aesthetic look, the pattern image on the pattern generation interface, or a plurality of process parameters can be modified by the user. For example, the user may modify the parameters (e.g., grayscale value, pattern density) inputted into the pattern generation interface. Alternatively, additional (second) laser irradiation units can be added and arranged along with the first laser irradiation units within the pattern area. As another alternative, the pattern area can be cleared and the parameters associated with the laser irradiation units can be newly selected to create a different pattern image.

The control device 104 includes a processor and associated circuitry to execute or direct the execution of machine-readable instructions to obtain, process, and generate information. The control device 104 retrieves and executes software from storage, which can include a disk drive, a flash drive, memory circuitry, and/or other memory devices, and which can be local or remotely accessible. The software includes computer programs, firmware, and/or other forms of machine-readable instructions, and may include an operating system, utilities, drivers, network interfaces, applications, and/or other software, including combinations thereof.

In an exemplary embodiment, the information associated with the pattern image generated at the pattern generation device 102 is in the form of an image file or pattern file, such as a bitmap, etc. The control device 104 is configured to receive information associated with the pattern image generated at the pattern generation device 102. Based on the information included in the pattern file, the control device 104 translates the pattern image information into machine-readable instructions for the laser control device 106. Those instructions instruct the laser control device 106 to process the surface of a fabric through laser irradiation based on the pattern image generated at the pattern generation device 102. For example, for each laser irradiation unit in the pattern image, the control device 104 may determine the applied power at which the laser operates. Power is reflected by laser settings applied to a finite area of the fabric over a finite period of time to change physical and/or chemical properties of the fabric, such as causing removal of the dye from the fabric and partially melting or disintegration of the fabric, particularly at the fabric surface. As used herein, references of lasing "on," "in," "onto" and "into" the fabric surface are used interchangeably to describe lasing operations that cause removal of dye from the fabric. Depending upon whether the fabric is made of natural or synthetic material, lasing may have an effect beyond the laser surface, such as partial disintegration of natural fibers or partial melting of synthetic fibers.

The laser control device 106 includes a processor and associated circuitry to execute or direct the execution of machine-readable instructions to obtain, process, and generate information. The laser control device 106 retrieves and executes software from storage, which can include a disk drive, a flash drive, memory circuitry, and/or other memory devices, and which can be local or remotely accessible. The software may include a computer program, firmware, or another form of machine-readable instructions, and may include an operating system, utilities, drivers, network interfaces, applications, or other software, including combinations thereof.

The laser control device 106 is configured to control various laser operational settings to process a pattern on a surface of a fabric through laser irradiation based on the instructions received from the control device 104. For example, the laser operational settings may control the amount of energy applied to the material (e.g., fabric) during the scribing/marking process. The amount of energy is typically measured in units of Joules, watts, or watts sec, usually refers to the output of a laser, and is related to power output. One skilled in the art is aware of the varied means that a user may have at their disposal to change the power output, whether that power is coming from a pulsed or continuous wave laser. Neither the pump source nor the waveform defines the invention. Power is a measure of energy transferred in a unit of time (e.g., watts) at a specified speed, typically in mm/sec or meters/sec.

For example, the laser control device 106 can adjust one or more laser operational settings. The laser operational settings that may be adjusted include, for example, power level, duty cycle, frequency (e.g., low frequency equates with short pulse duration and high peak power to apply high energy in a short period of time), pulse width, pulse period, scan speed (the marking speed of the laser beam relative to the substrate), beam spot size, pixel time, pixel threshold color, and focal distance associated with the laser in order to create the pattern on the surface of the fabric based on the instructions provided from the control device 104 to the laser control device 106. The duty cycle may be modified to create a continuous beam effect relative to the output of the laser, the scan speed, and the responsiveness of the substrate, or a pulsing beam relative to scan speed and the responsiveness of the substrate, where the duty cycle is a ratio of the time a laser is on and a time the laser is off. For example, when the duty cycle and frequency are selected to pulse the laser beam at a certain level, the resulting pattern formed on the surface of the fabric is an intermittent line where unprocessed, or non-color modified, spaces (also referred to herein as discontinuities) are formed between adjacent processed, or color modified, portions of the lased pattern. Alternatively, the duty cycle and frequency may be selected to lase a continuous solid line as part of the resulting pattern lased onto the surface of the fabric.

For example, the laser operational settings for a $CO_2$ laser system such as the MarcaTex Flexi Laser System made by EasyLaser for Jeanologia include laser duty cycle settings, laser pulse duration, laser scan or marking speed settings, laser pulse period settings, pixel threshold color, pixel time settings, laser spot size, and laser pulse repetition frequency settings. Other laser systems have laser power settings which also control the amount of energy applied to the material during scribing or marking. Threshold color is the grayscale level at which the marked image is filtered and may be set at a default level of 220. Pixel time is a parameter that determines the amount of energy applied to the substrate or the intensity of the marking. Pixel time is a function of speed. The higher the pixel time, the more energy is applied to the given area of the substrate. The grayscale values of the image can be adjusted using ADOBE PHOTO SHOP®.

Typically, the fabric is colored with dye prior to lasing. In the case of denim, the dye often colors the fabric indigo, although other colors are known and may be used with the invention. When the fabric is exposed to lasing (irradiation), dye absorbed in the fabric can remain unchanged in color, can be completely removed or transformed to create white fabric, or can be partially removed or transformed to achieve a color between those extremes, depending upon the settings (e.g., energy, frequency, etc.) of the laser to which the fabric and its absorbed dye are exposed.

In an exemplary embodiment, information associated with the amount of dye to be removed from the fabric (or associated laser operational settings) can be included within the pattern file communicated from the pattern generation device 102. For example, the control device 104 can correlate dye removal values to laser operational settings based on the color intensity level of the laser irradiation units using a look up table stored in the control device 104. For instance, when a laser irradiation unit has a maximum grayscale value (e.g., darker grayscale shade), the corresponding color intensity level can be a maximum level in order to create a laser irradiated area on a surface of the fabric that has high contrast with respect to the original color of the fabric.

The dye removal parameter, and in particular the amount of dye to be removed from the fabric, is subject to user-preselected laser operational settings. The user preselects the laser operational settings of the laser system. The user-preselected operational settings of the laser may allow for only partial (not complete) removal of the dye from the fabric, even when the dye removal parameter is selected as a value corresponding to maximum dye removal. For example, on a grayscale value of 0 to 255, a grayscale value of 0 corresponds to a color black on the user interface and a maximum dye removal value. The amount of dye actually removed by the laser will depend upon the pre-selected laser operational settings. If the user-preselected operational settings produce a relatively high energy laser, lasing at the zero grayscale value may remove all or substantially all of the dye within the area on the fabric (e.g., so that the color of the area on the lased fabric is white or near white). Alternatively, if the user-preselected operational settings produce a relatively low energy laser, lasing at the zero grayscale value may remove a certain percent (e.g., 60%, 80%, etc.) of the dye within the area of the fabric.

On the other hand, the highest grayscale value of 255 corresponds to the lighter grayscale shade on the user interface, and is associated with removal of a minimal amount of dye. The user-preselected operational settings may correspond the 255 grayscale value with a marking threshold, i.e., an amount of energy necessary to obtain minimum marking of the fabric. In other words, when a laser irradiation unit has the lightest grayscale shade, the least amount of is removed from the lased area on the fabric (e.g., the color of the area on the lased fabric is slightly lighter than the original color of the fabric). A user can also selectively identify and correlate the laser irradiation units to any respective power level and utilize any color scale. In an exemplary embodiment in which the grayscale range is from 0 to 255, a user can define grayscale values 0-2 to equal 100% of the available power based on the user-preselected operational settings, 3-5 equal to 99.5%, etc.

Other laser operational settings can be used to control laser power. For example, the duty cycle (or other power varying means) may be modified to create a contrast within the pattern where different laser irradiation units have different grayscale level distributions, with each grayscale level being correlated with a respective energy output level being applied to the fabric by the impinging laser beam. A minimum power requested from the laser can correspond to the minimum grayscale value (e.g., the least modified color intensity of the fabric) of the pattern and is scaled proportionally to create the full grayscale color values identified. The scan speed may be modified to create various speeds at which the laser is scanned above the fabric to process the surface of the fabric. For example, the higher the scan speed, the lower the applied power impinging upon the surface of the fabric because the laser irradiates a selected area for a reduced amount of time. Slow scan speeds increase the applied power impinging upon the surface of the fabric because the laser irradiates a selected area for a longer period of time. Modifying the beam spot size results in a change in the area in which the laser irradiates the surface of the fabric where the beam spot size can be modified by distance number of different techniques. The smaller the selected beam spot size, the smaller the area impinging upon the surface of the fabric by the laser. The larger the beam spot size, the larger the area impinging upon the surface of the fabric by the laser. A person skilled in the art having reference to this disclosure can select laser operating settings to control power to overcome or exaggerate the effects of varying spot size.

Figure 2:
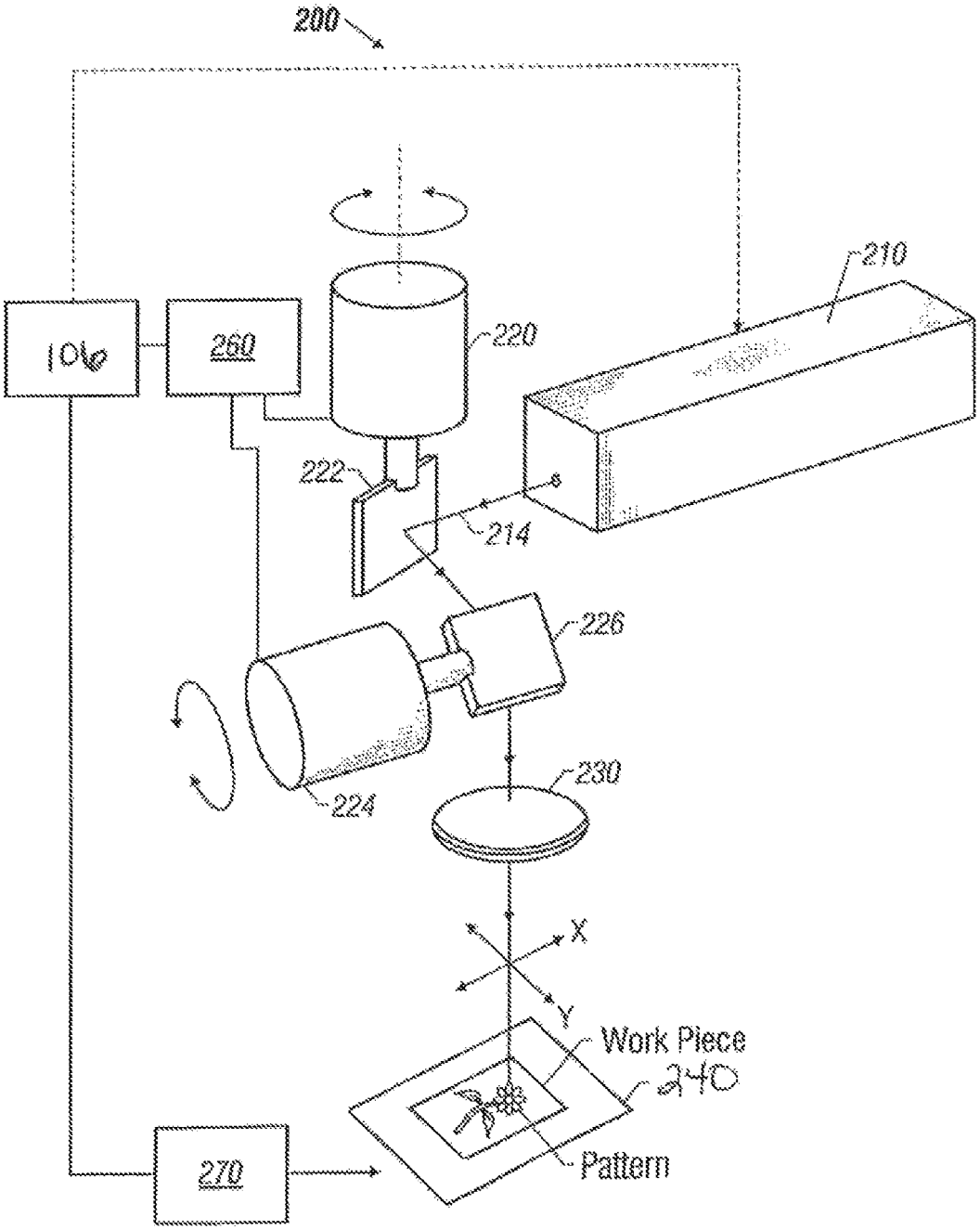
FIG. 2 illustrates an exemplary laser system for processing a surface of a fabric according to an exemplary embodiment.

FIG. 2 illustrates an exemplary laser system 200 for processing a surface of a fabric according to an exemplary embodiment of the present invention. FIG. 2 illustrates the pre-objective scanning architecture option where the scanning mirrors 222 and 226 are located before the focus or objective lens 230. However, the laser system 200 can alternatively include a post-objective scanning architecture where the scanning mirrors 222 and 226 are located after the focus or objective lens 230. The laser system 200 includes a laser 210 configured to produce a laser beam having a range of applied power levels. The laser system 210 preferably has a maximum effective power of 2500 to 5000 Watts for economic viability, but the process is possible with a laser output power as low as about 50 watts. The system may involve a plurality of lasers configured as necessary to achieve different beam diameters, or to achieve a desired throughput. The laser 210 can be a $CO_2$ laser or a YAG laser. The laser 210 can further include a controllable beam shutter (not illustrated) to block the beam path.

The laser 210 generates a laser beam 214 and is then directed inline with a beam steering and scanning device having a first mirror 222 and a second mirror 226. The first mirror 222 is mounted on a first galvanometer 220 so that the first mirror 222 can be rotated to move the beam in an x-axis on the support stage 240. A second galvanometer 224 is used to control the second mirror 226 so that the second mirror 226 can move the beam on the support stage 240 along a y-axis. One of ordinary skill in the art understands that the order of beam delivery to the x or y mirror could be reversed, or interpreted through field manipulation within laser control software. In other words, the mirrors 222 and 226 can be controlled to scan the laser beam on the support stage 240 to generate any trace or geometric shape associated with the generated pattern to process the surface of the fabric through laser irradiation. A galvanometer driver 260 receives commands including numerical control commands from laser control device 106 and respectively controls the movement of each mirror 222, 226.

The laser beam 214 is deflected first by the x-axis mirror 222 and subsequently by the y-axis mirror 226 to direct the beam through a focusing lens 230. The lens 230 is preferably a multi-element, flat-field, focusing lens assembly, which is capable of optically maintaining the focused spot on a flat plane as the laser beam moves across the material. A movable stage (not shown) may be used to hold the lens 230 so that the distance between the lens 230 and the support stage 240 can be changed to alter the beam spot size. Alternatively, the support stage 240 can be moved relative to the lens 230. The support stage 240 has a working surface which can be almost any substrate including a table, or even a gaseous fluidized bed. A work piece (e.g., fabric to be processed through laser irradiation) is placed on the working surface. Usually, the laser beam is directed generally perpendicular to the surface of the support stage 240, but it may be desirable to guide the beam to the surface with an angle to achieve certain effects. For example, the incident angle may range between about 45° and about 135°. The system optionally may include a gas tank 270.

In operation, a pattern area is provided at the pattern generation interface of the pattern generating device 102. The pattern area can include an array of pixels. One of ordinary skill of the art understands that a pixel is a non-standardized unit of measure, as its size dependent on the given DPI. A user can further define an area parameter of the laser irradiation unit (also referred to herein as the laser irradiation unit area). The laser irradiation unit area can comprise one or more pixels. Alternatively, the area parameter may be defined in millimeters, centimeters, inches, or other defined units of measurement.

The user selects a laser irradiation unit density parameter associated with the pattern area. In exemplary embodiments, the laser irradiation density corresponds to a probability that a laser irradiation unit will be assigned to a particular pixel of the pattern area. A plurality of laser irradiation units are arranged within the pattern area based on the laser irradiation unit density selected by the user. In addition, a dye removal parameter representing an amount of dye to be removed from the fabric is selected by the user for the laser irradiation units, the amount of dye to be removed being subject to laser operational settings. The dye removal parameter may have an impact on, for example, the applied power, which correlates to properties of the laser beam at the point at which the laser beam impinges upon the fabric to be processed through laser irradiation.

After the image of the pattern (i.e., the pattern image) is generated at the pattern generating device 102, it is communicated to the control device 104. The pattern image can be communicated between the pattern generating device 102 and the control device 104 over a wired or wireless communication link 108 (FIG. 1). The control device 104 converts the pattern image into laser beam instructions, and communicates the instructions to the laser control device 106 over a wired or wireless communication link 110 (FIG. 1). The laser controller device 106 processes the surface of the fabric through laser irradiation based on the instructions received at the laser control device 106 from the controller device 104 and the pattern image generated at the pattern generating device 102.

Figure 3:
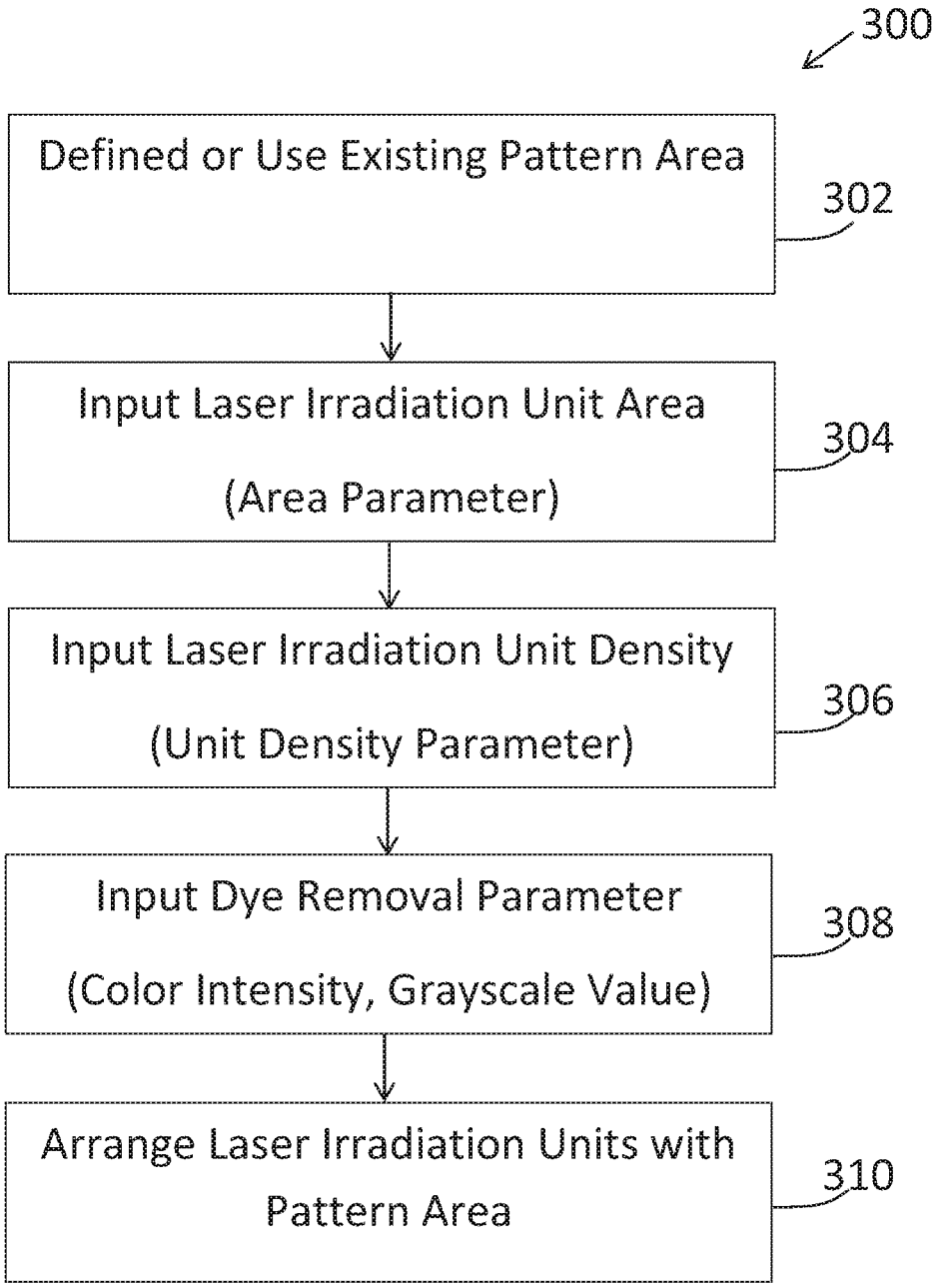
FIG. 3 illustrates a flow chart of an exemplary method of generating a pattern for processing a surface of a fabric according to an exemplary embodiment.

FIG. 3 illustrates a flow chart of an exemplary method 300 for generating a pattern image used to process a surface of a fabric through laser irradiation. The method will be discussed with reference to the exemplary laser patterning systems 100 and 200 illustrated in FIGS. 1 and 2. However, the method can be implemented with any suitable laser patterning system. In addition, although FIG. 3 depicts steps performed in a particular order for purposes of illustration and discussion, the methods discussed herein are not limited to any particular order or arrangement. A person having ordinary skill in the art, using the disclosures provided herein, will appreciate that various steps of the methods can be omitted, rearranged, combined, and/or adapted in various ways.

At 302, a pattern area is defined. For example, a user defines a pattern area within a pattern generation interface at the pattern generating device 102. The pattern area includes a two-dimensional array of pixels. The pattern area may be embodied differently, for example, as a series of vectors of one or varied colors to achieve similar variations in size, shape, length, and applied power intensity. For instance, the pattern area can be defined to include various field sizes such as 10×10, 20×20, 50×50, etc. where the field size may be in inches, millimeters, or some other unit of measurement. Laser irradiation units are arranged within the pattern area to create a pattern image to be processed using devices 104 and 106 to lase a corresponding pattern onto a surface of a fabric by application of laser irradiation. The processing of the fabric by lasing to form the corresponding pattern involves the removal of dye from the fabric. Lasing may also cause incidental partial melting of synthetic fibers or partial disintegration of natural (e.g., cotton) fibers.

The pattern area can be defined by the user through manipulation at the interface to have any shape such as square, rectangular (e.g., 20×10 array), circular, oval, hexagonal, custom irregular shapes, etc. The defined pattern area correlates to an area to be processed on a surface of a fabric through laser irradiation of a given pattern. In an exemplary embodiment, the defined pattern area can be repeatedly lased along the length and width of the fabric such that the defined pattern areas are aligned and arranged adjacent to one another. For example, fabric is frequently stored or created on rolls, and implementation of the embodiment allows the pattern to be applied across the width of the fabric roll and also along its length, thus allowing the entire surface of the roll to be treated. As the length is limited to the size of the marking field, multiple files may be processed as repeats, or as continuous patterns that adjoin one another for the duration of the roll. Further, due to the flexibility of use of pattern generating device 102, different patterns may be created and applied at different fabric areas across the width of the roll. In this and other embodiments described herein, the pattern may be applied, for example, either through irradiation by a single laser or through multiple lasers each lasing (irradiating) a defined portion of the roll.

Figure 21:
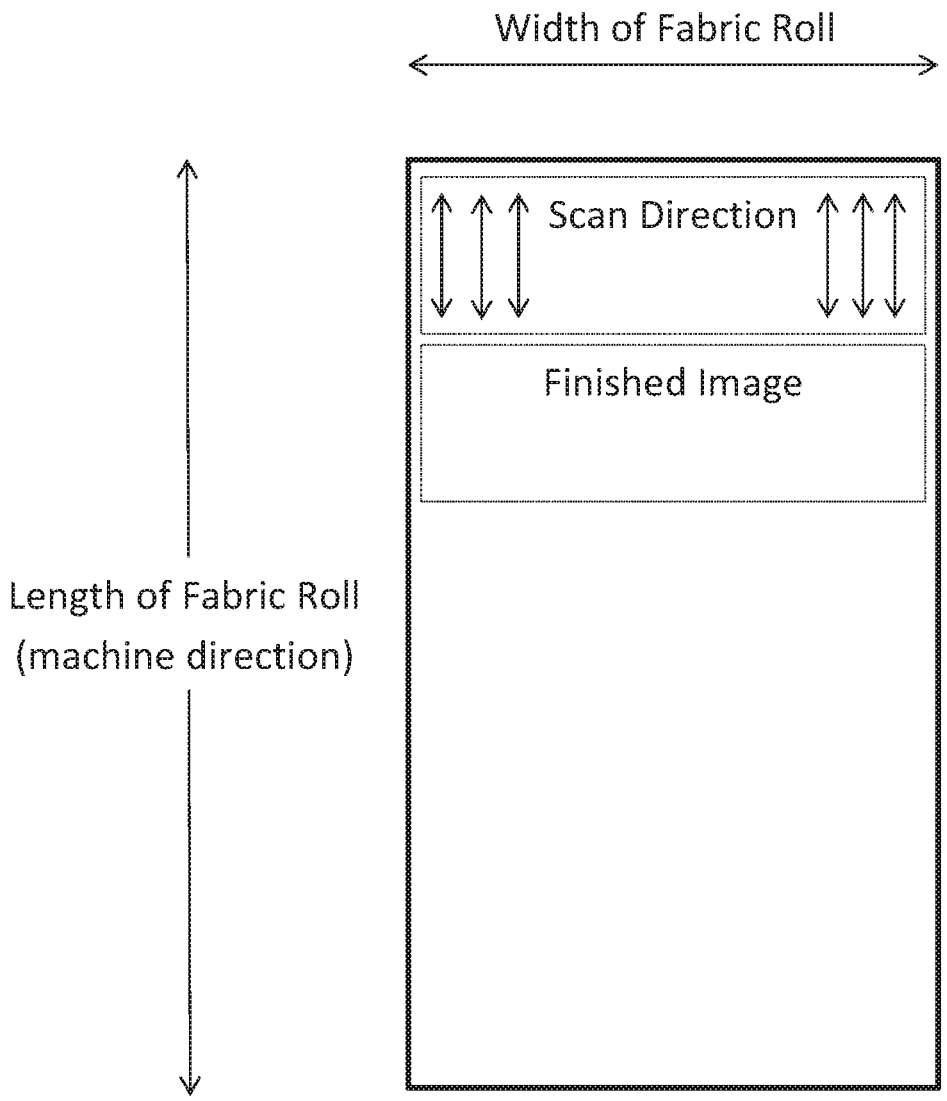
FIG. 21 illustrates an exemplary method of lasing an image on a surface of a fabric according to an exemplary embodiment.

In an exemplary embodiment, as best illustrated in FIG. 21, a fabric roll is processed to create a pattern on the surface of the fabric where the pattern is created using scan lines applied in the direction of the length of the fabric. The scan lines can be applied to the fabric within an area of the fabric corresponding to the pattern area of the pattern generation interface. The pattern area can be defined to have a width corresponding to a width of the fabric roll or to a portion (e.g., fraction) of the width of the fabric roll. In addition, the length of the pattern area can be selected to be any dimension. For example, when the fabric roll has a width of 60 inches, a pattern can be created to have an area that is 60 inches wide (e.g., corresponds to the entire width of the roll) and 6 inches in length where the pattern is then repeated every 6 inches along the length of the fabric roll. While 6 inches is used as a representative length dimension of the pattern area, one of ordinary skill in the art reading this application will recognize that any length within the laser operating field can be selected, although the length is preferably sufficient that the repetition of patterns is not readily evident to a viewer of the processed fabric. As the laser processes the surface of the fabric to include the pattern, the laser beam is scanned along the length of the fabric (e.g., each scan line corresponds to the 6 inches dimension of the pattern area) as the laser beam head is translated across the width of the fabric roll. After the pattern corresponding to the pattern image is lased onto the 60×6 area of the roll, the next pattern is lased (or the pattern is repeated) onto an area of the surface of the fabric roll adjacent to the previously processed area. As noted above, individual patterns may be applied, for example, either through irradiation by a single laser or through multiple lasers each irradiating a defined portion of the roll.

It is noted that the fabric area corresponding to the pattern area of the pattern generation interface is illustrated in FIG. 21 to be slightly less than the width and spaces between images created in the fabric for clarity and ease of illustration. However, preferably, the fabric areas are juxtaposed, one fabric area directly adjacent to and abutting another fabric area, such that adjacent fabric areas do not overlap on the surface of the fabric. In addition, it is further preferred that the fabric area corresponding to the pattern area of the pattern generation device is equal to the width of the fabric roll rather than slightly less as illustrated in FIG. 21. The dimensions of the fabric area and drawing direction on the denim roll can change depending upon the type of graphic and size of the denim roll. For example, while the scanning direction is described as occurring in the length direction of the fabric roll, the scanning direction could alternatively be in the width direction, or performed on the bias (e.g., in a diagonal direction) of the fabric. Logos, purposeful destruction, artwork, or cutting patterns could be similarly processed through a series of lines, arcs, or polylines.

A laser irradiation unit area is defined at step 304 in FIG. 3. For example, a user can define a laser irradiation unit area using the pattern generation interface at the pattern generating device 102. The laser irradiation unit area is the smallest area used to create the pattern image. The laser irradiation unit area can be defined to include at least one pixel of the pixel array of the pattern area. In an exemplary embodiment, the laser irradiation unit area can be defined to include 1, 2, 3, 4, or 5 pixels in length and 1, 2, 3, 4, or 5 pixels in width, independently, to generate a pattern image having the intensity density useful to re-create a stonewash and enzyme, among other patterns. More or fewer pixels can be selected depending on the desired pattern. For instance, when a ring spun pattern image is desired, the laser irradiation unit area may correspond to the lines created within the pattern image. For linear shaped laser irradiation units, the area parameter may include selection of a minimum and maximum line length values and a minimum and maximum line width values. Various minimum and maximum length values and width values can be selected. For example, a range of lengths can include 5-100 pixels and a range of widths can include 1-5 pixels.

In addition, the laser irradiation units can have pixels collectively arranged in various shapes such as a square, a circle, a slice, a custom-selected shape, and a line.

Figure 4:
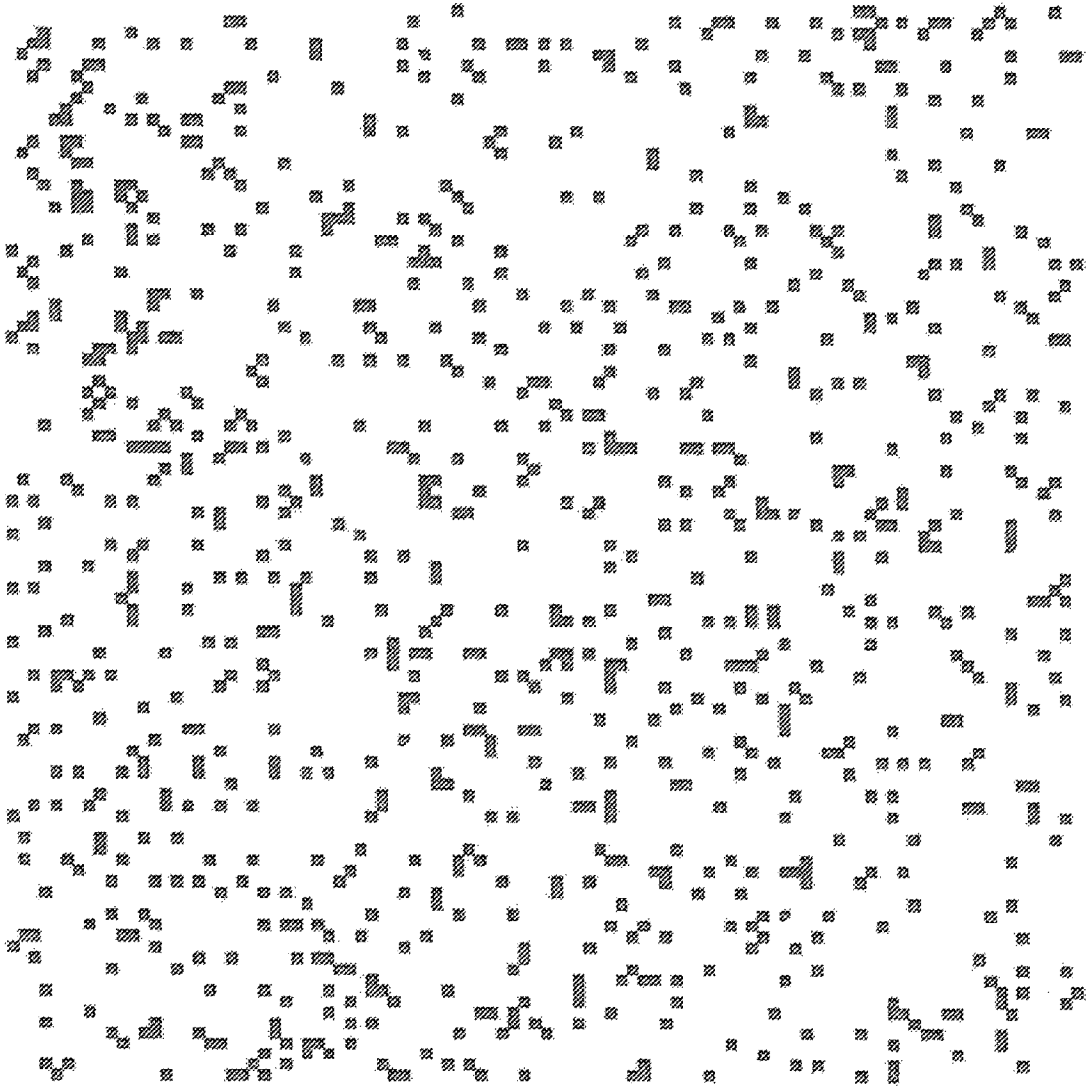
FIGS. 4 and 5 illustrate various patterns generated for processing a surface of a fabric having various laser irradiation unit areas according to exemplary embodiments.
Figure 5:
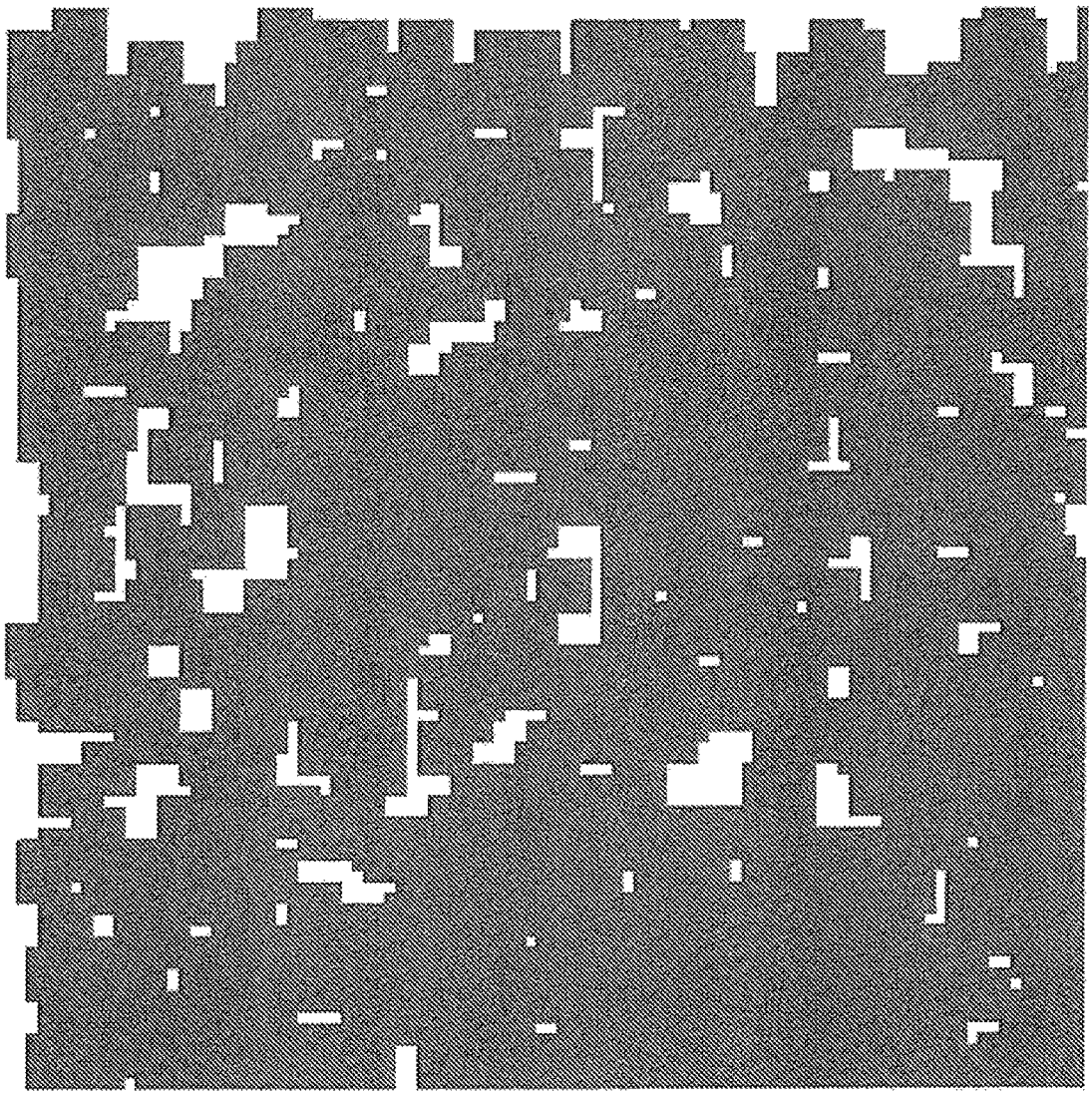

FIGS. 4 and 5 illustrate the different coverage densities within the pattern image based on the selected laser irradiation unit parameters. For example, FIG. 4 illustrates an exemplary embodiment having a laser irradiation unit area defined as one pixel and FIG. 5 illustrates an exemplary embodiment having a laser irradiation unit area defined as 5×5 pixels.

When the laser irradiation unit area is defined to include more than one pixel, adjacent laser irradiation units can overlap such that one pixel (or more than one pixel) can be associated with two or more laser irradiation units. A higher contrast pattern can be created on the surface of the fabric by using different (e.g., first and second) laser irradiation units each associated with a different grayscale/intensity values.

If the dye removal value (such as represented by grayscale or color intensity values) of the two adjacent laser irradiation units are different, the grayscale value of the overlapping area can be determined in various ways. For example, the overlapping pixel can be selected to include a grayscale/color intensity value associated with either one of the two laser irradiation units. In other words, if a first grayscale value associated with a first laser irradiation unit is gray and a second grayscale (or color intensity) value associated with a second laser irradiation unit is black, and the darker (i.e., black) grayscale value of the second laser irradiation unit may be selected, and the overlapping pixel will result in a laser irradiation unit dye removal value of black. Alternatively, the grayscale value of the overlapping pixel can be determined by averaging the two grayscale (or color intensity) values together to create a grayscale (or color intensity) value associated with the overlapping pixel that has different grayscale (or color intensity) value from either of the adjacent laser irradiation units.

At 306 (in FIG. 3), a laser irradiation unit density associated with the pattern area is selected. For example, a user can select a laser irradiation unit density associated with the pattern area within the pattern generation interface at the pattern generating device 102. A laser irradiation unit density can correlate to a probability that a pixel within the pattern area will be selected as or associated with a laser irradiation unit. In an exemplary embodiment, when a small laser irradiation unit density is selected, a small number of laser irradiation units are arranged within the pattern area, and a relatively small percentage of the fabric surface is irradiated so that the resulting fabric has an overall darker (e.g., indigo) color. On the other hand, when a large laser irradiation unit density is selected, the laser irradiation units are arranged over a greater percent of the pattern area, and a larger percentage of the pattern area will be processed through laser irradiation, thereby creating a fabric having an overall lighter average color with respect to the original color of the fabric.

Figure 6:
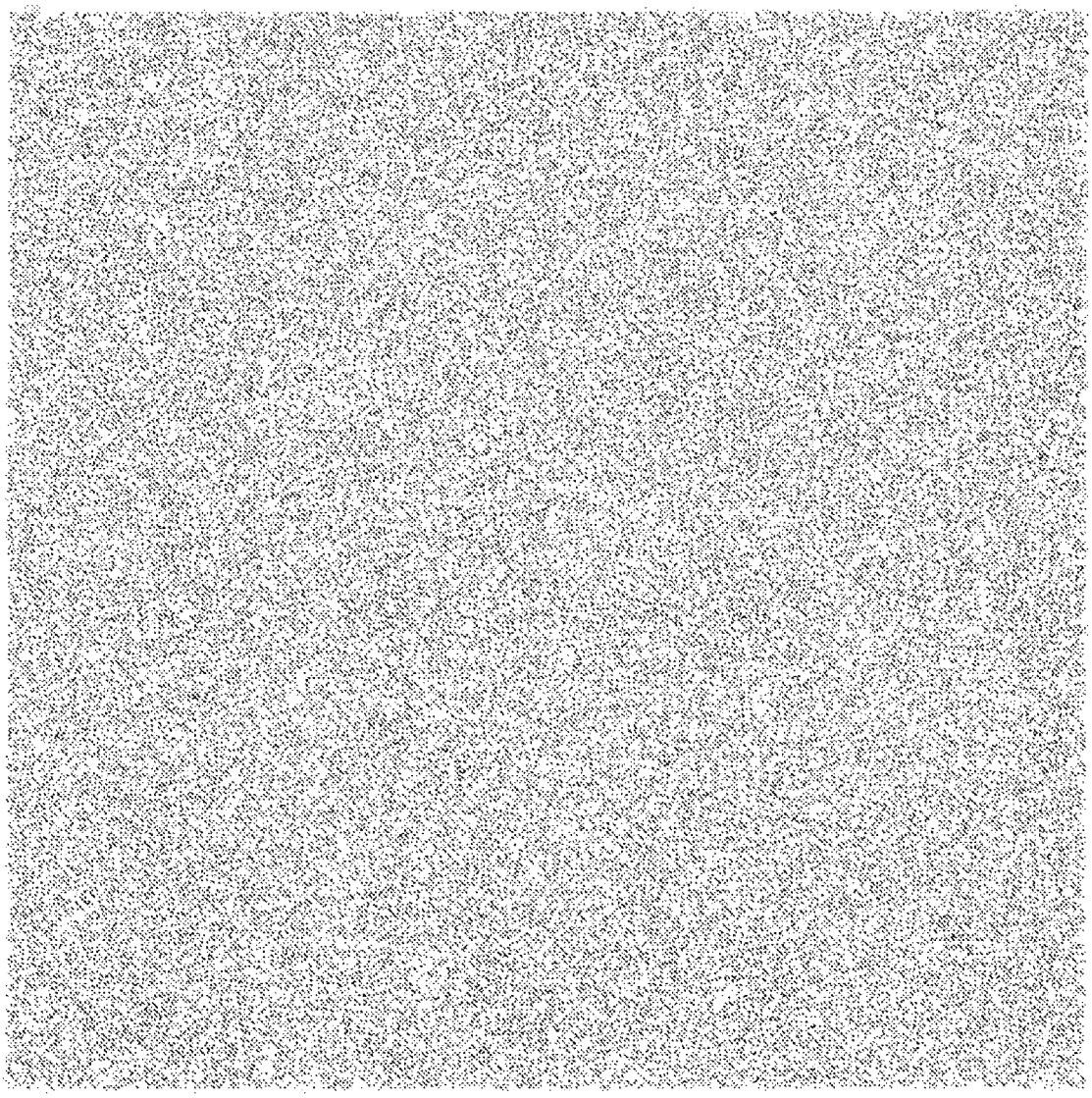
FIGS. 6-8 illustrate various patterns generated for processing a surface of a fabric having various laser irradiation unit densities according to exemplary embodiments.
Figure 7:
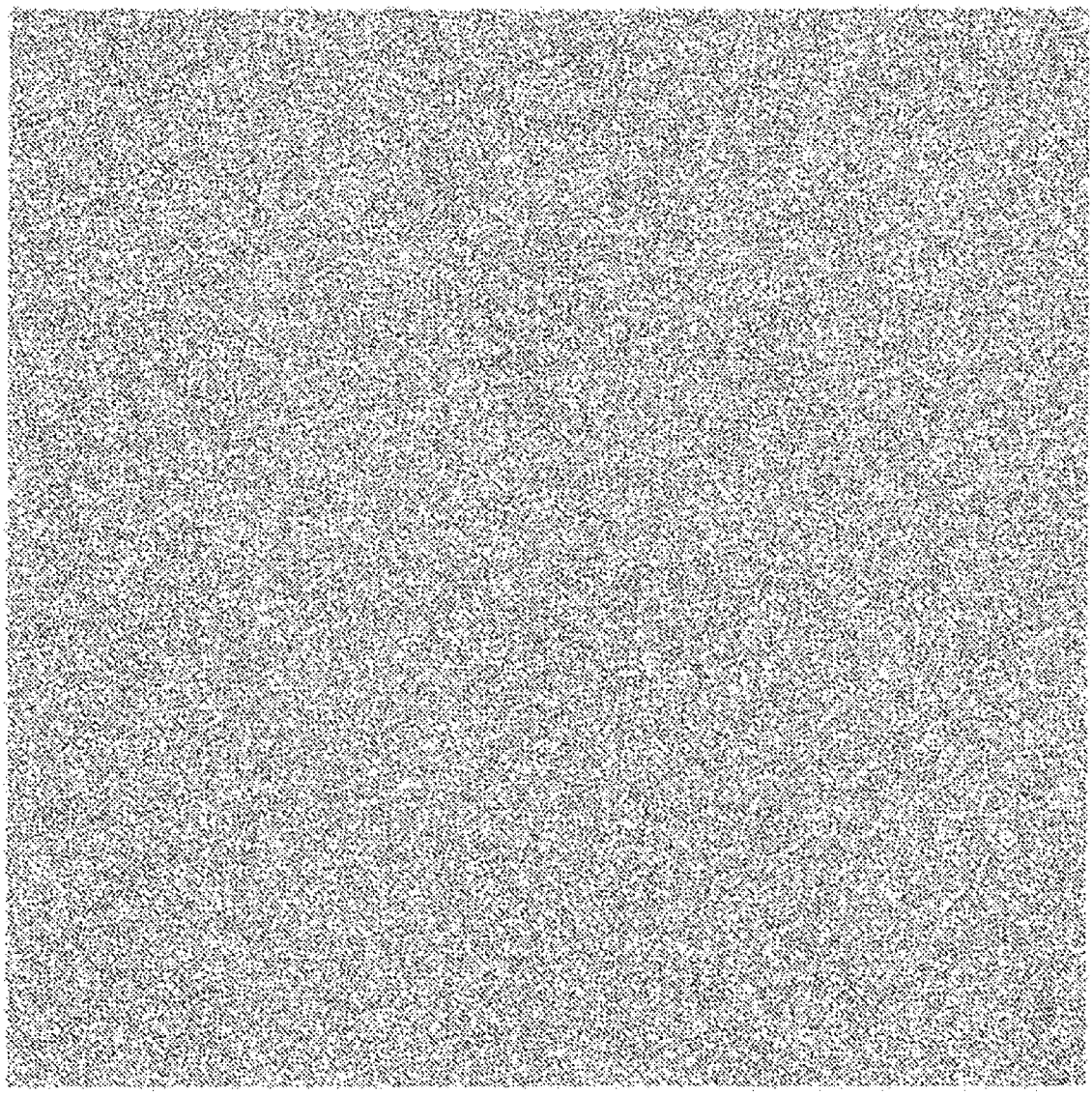
Figure 8:
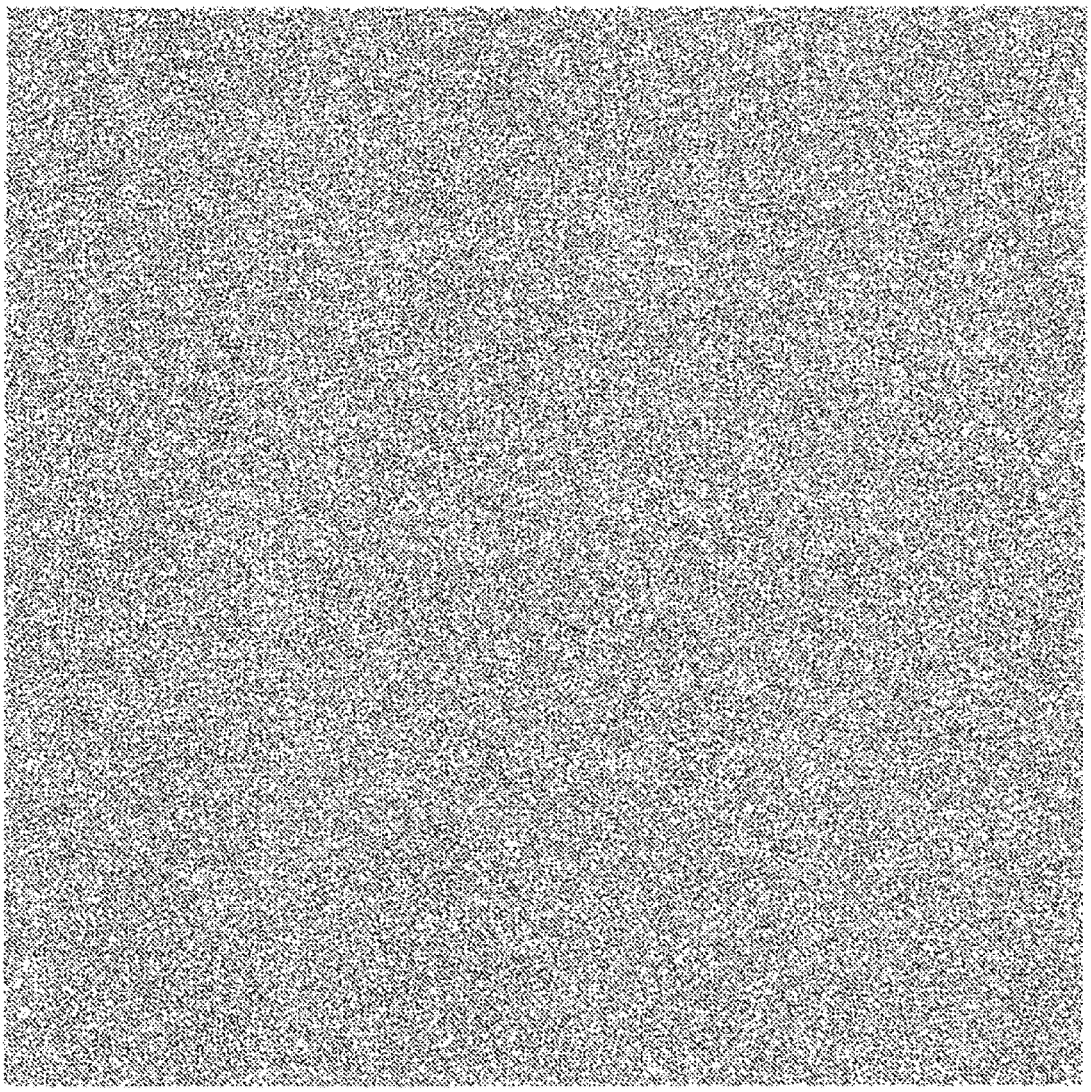

FIGS. 6-8 illustrate exemplary embodiments of various laser irradiation unit densities where the laser irradiation unit area is defined to be the same for each example. For example, FIG. 6 illustrates a pattern having a laser irradiation unit density of 20%, FIG. 7 illustrates a pattern having a laser irradiation unit density of 50%, and FIG. 8 illustrates a pattern having a laser irradiation unit density of 70%.

In an exemplary embodiment, the laser irradiation unit density can be based on a percentage such that the percentage correlates to a probability that a pixel within the pattern area will be selected as a laser irradiation unit. After the laser irradiation unit density is selected, each pixel within the pixel array of the pattern area is sequentially identified and a decision is made as to whether to identify the selected pixel as a laser irradiation unit. Whether or not a pixel is selected is based on the defined laser irradiation unit area, the selected laser irradiation unit density, and optionally other parameters (such as skip and gap settings, discussed below). In an exemplary embodiment, the decision whether a pixel is selected can be performed based on a random number generator where the likelihood of a pixel being selected is based on the selected laser irradiation unit density or probability.

For example, when a pattern area consists of an array of 100 pixels by 100 pixels (e.g., 10,000 total pixels, 100 pixels within each row in a horizontal direction (x-direction) and 100 rows in the vertical direction (y-direction)), a laser irradiation unit area is defined to be one pixel, and a laser irradiation unit density is selected to be 10%. Applying these parameters, the number of laser irradiation units defined within the pattern area equals approximately 1000 pixels. This number (1000 pixels) is approximate because when a random number generator is used to determine the number of laser irradiation units, the total number of laser irradiation units could be slightly greater than or slightly less than the 1000 pixels due to the inherent properties of the random number generator.

When a second laser irradiation unit density of second laser irradiation units is selected to be included within the same pattern area as the first laser irradiation units at the same 10% level, another approximately 1000 laser irradiation units are arranged within the pattern area such that a total of approximately 2000 laser irradiation units are included in the pattern area. However, one of ordinary skill in the art reading this specification will appreciate that some of the second laser irradiation units may overlap the first laser irradiation units already arranged within the pattern area, thereby potentially reducing the total number of pixels on which first and/or second laser irradiation units are arranged to less than 2000.

In another exemplary embodiment, the pattern area density can be defined to be 100% where each pixel within the pattern area includes a laser irradiation unit. In this embodiment, the resulting pattern created on the surface of the fabric will emit at least some energy on each corresponding area of the fabric (assuming that the effective energy of each laser irradiation unit is greater than zero). In other words, the overall base color of the fabric will no longer correspond to the original color of the fabric. Instead, the darkest resulting area on the surface of the fabric will have at least some dye removed by lasing, making the area lighter in color than the original color of the fabric.

Returning to FIG. 3, laser irradiation units are arranged within the pattern area at 308. For example, when a pixel is associated with a laser irradiation unit, a laser irradiation unit is illustrated at that pixel within the pattern area. The laser irradiation unit has an area equal to the area parameter value selected for the laser irradiation unit by the user. When a shape of the laser irradiation unit is selected, the laser irradiation unit has the shape of the laser irradiation unit selected by the user. In addition, dye removal values for the laser irradiation units can be selected by the user. The dye removal value can be represented by grayscale value, color intensity, or color.

In an exemplary embodiment, the following representative parameters can be input into the pattern generating device 102 by a user to create an enzyme and stonewash pattern: an area parameter with a length and a width both in the range of 1-3 pixels, a laser irradiation unit density associated with the pattern area in the range of 10-80%, a number of colors (or color intensities or grayscale values) included within the pattern area of 3-10, and a number of times a new laser irradiation unit density value is selected in the range of 1-3.

The following representative parameters can be input into the pattern generating device 102 by a user to create a ring spun pattern: a line shape, area parameters including a length in the range of 5-100 pixels and a width of 1-3 pixels, a laser irradiation unit density in the range of 20-100%, a number of colors included within the pattern area in the range of 3-10, and a number of times a new laser irradiation unit density is selected in the range of 1-15. The above parameters are illustrative and provided as examples.

Figure 9:
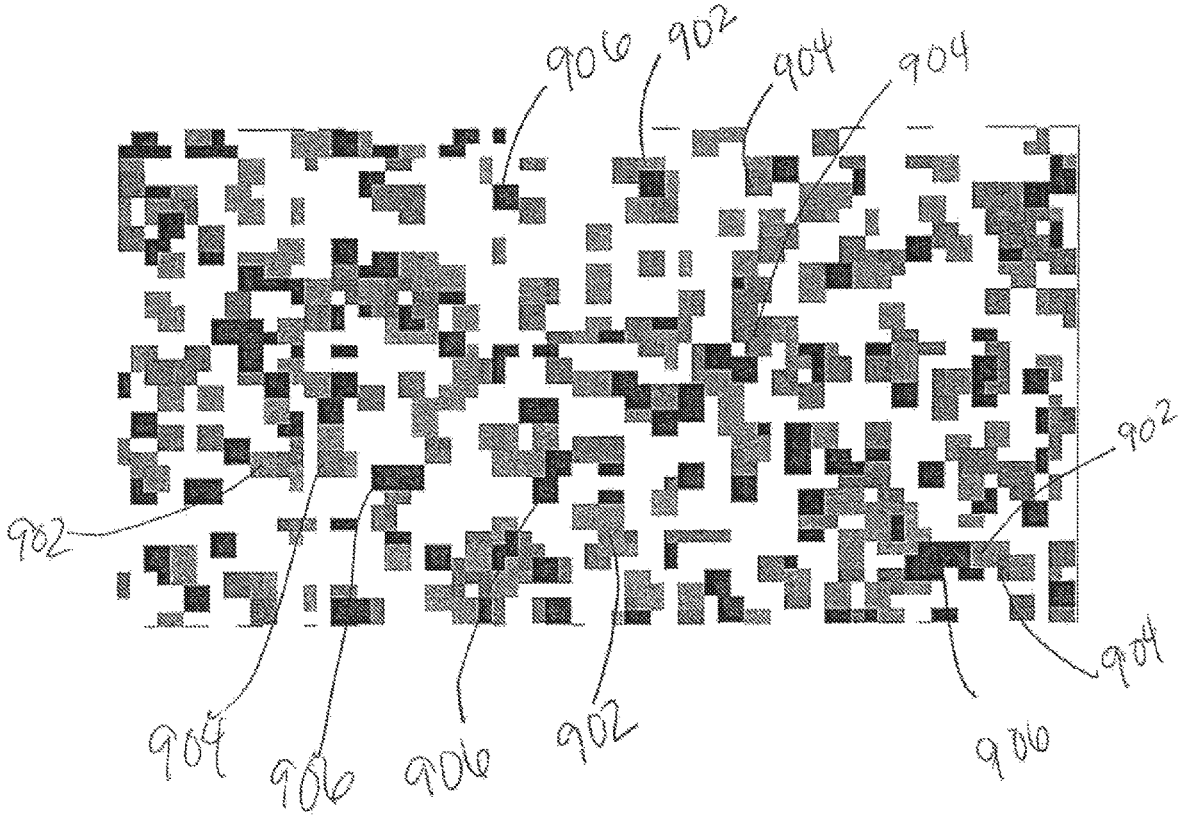
FIG. 9 illustrates a magnified portion of a pattern generated for processing a surface of a fabric according to exemplary embodiments.

FIG. 9 illustrates an enlarged portion of a pattern area of an exemplary embodiment after laser irradiation units have been arranged in the pattern area. In the exemplary embodiment illustrated in FIG. 9, three different colors or color intensities (dye removal parameter values) were selected to be associated with the laser irradiation units. Laser irradiation units 902 correspond to a first color or color intensity, laser irradiation units 904 correspond to a second color or color intensity, and laser irradiation units 906 correspond to a third color or color intensity. One of ordinary skill in the art reading this specification will recognize that while three different colors or color intensities are associated with the laser irradiation units are illustrated in FIG. 9, any number of colors or color intensities may be associated with the laser irradiation units. For example, up to 256 different grayscale values can used to generate a pattern image to process a surface of a fabric through laser irradiation and thus, in this example, up to 256 different dye removal values can be used.

At 310, a dye removal value can be identified. For example, one dye removal value can be identified for all of the laser irradiation units. Alternatively, each of the laser irradiation units can be assigned a corresponding dye removal value, wherein the dye removal values of different laser irradiation units differ from one another. In an exemplary embodiment, the dye removal values of the laser irradiation units corresponding to a single color or color intensity can be the same. The dye removal values are associated with respective energy or power levels, which correlate to properties of the laser beam at the point at which the laser beam impinges upon the fabric to be processed through laser irradiation. Therefore, when a higher dye removal value is selected to correspond to a laser irradiation unit, the resulting area of the fabric processed through laser irradiation experiences increased application of energy and hence greater dye removal than the resulting area of the fabric processed through laser irradiation with a reduced application of energy.

In an exemplary embodiment, the user individually identifies the dye removal value of each laser irradiation unit or each type of laser irradiation unit within the pattern generator interface of the pattern generator device 102. The pattern generator device 102 and/or the control device 104 can automatically correlate the dye removal value of each laser irradiation unit or each type of laser irradiation unit to an associated applied power. The correlation between the dye removal values and the applied powers of the laser and the laser irradiation units can be done in various ways. For example, the different powers of the laser can be stored as a look up table where a specific dye removal value is associated with a specific power level.

When a plurality of laser irradiation units each associated with a corresponding dye removal value is used, the respective densities of the different laser irradiation units can differ from one another. For example, a density of first laser irradiation units associated with a first dye removal parameter can be less than a density of second laser irradiation units associated with a second dye removal parameter. In an exemplary embodiment, when the first laser irradiation units are selected to be associated with a first color or color intensity, and the second laser irradiation units are selected to be associated with a second color or color intensity, the density of first laser irradiation units within the pattern area can be greater or less than or equal to the density of second laser irradiation units depending on the contrast and color intensity desired on the surface of the fabric. When the resulting fabric is desired to be darker, the ratio of laser intensity units having a dye removal value associated with a lower effective power level to laser intensity units having a dye removal value associated with a higher effective power level is increased. On the other hand, when the resulting fabric is desired to be lighter, the ratio of laser intensity units having a dye removal value associated with a higher effective power level to laser intensity units having a dye removal value associated with a lower effective power level is increased.

In an exemplary embodiment, a first laser irradiation unit density and a second laser irradiation unit density can be selected, where a plurality of first laser irradiation units are arranged within the pattern area before the second laser irradiation units are arranged within the pattern area. The second irradiation unit density can be selected before or after the first laser irradiation units are arranged within the pattern area. In this embodiment, the second laser irradiation units are arranged within the pattern area after the first laser irradiation units are arranged within the pattern area. The first and second laser irradiation units can be lased onto the fabric surface simultaneously or consecutively as separate layers.

In an exemplary embodiment, at least one of the second laser irradiation units overlaps at least one of the first laser irradiation units within a single pixel. When a first laser irradiation unit and a second laser irradiation unit overlap within a single pixel of the pattern area, the dye removal value of the second laser irradiation unit may be selected for the overlapped pixel. The first laser irradiation unit can be identified to have a dye removal value associated with the same or different applied power as the second laser irradiation unit in this embodiment.

For example, when the second laser irradiation unit density is selected to increase the total number of laser irradiation units within the pattern area and the applied power of the first and second laser irradiation units are the same, the pattern surface of the fabric can result in an area that experiences greater dye removal due to the increased in amount of area that is processed using the laser (because of the increase in total laser irradiation units). Alternatively, when the second laser irradiation unit density is selected to increase the various levels of color intensity, the dye removal value of the first laser irradiation units can be different from the dye removal value of the second laser irradiation units. This creates a pattern that provides greater contrast within the surface of the fabric after being processed by the laser.

In an alternative embodiment, an average of the first unit and the second unit color intensity levels can be determined where the pixel associated with the overlapping units corresponds to the average color or intensity level of the units.

If the first laser irradiation unit has a dye removal value associated with a low applied power and the second unit has a dye removal value associated with a high applied power, the two colors intensity levels can be blended together to form an average dye removal value associated with an average applied power when the user intends to merge the two layers and process the layers as a single entity. Alternatively the user may process both the first unit, as well as the second unit over the same portion of the roll, thus creating a scenario where marking areas may be subject to irradiation multiple times.

While grayscale value, color or color intensity are described above, one of ordinary skill in the art reading this specification will recognize that any number of types of indicators can be used to specify dye removal.

Where there is more than one type of laser irradiation unit, for example first laser irradiation units associated with a first dye removal parameter and second laser irradiation units associated with a different second dye removal parameter, the first and second laser irradiation units can be distributed within the pattern area simultaneously or consecutively. When the different laser irradiation units are distributed consecutively, the first and second laser irradiation units can be stored as separate image files or separate layers where the layers can be sent to the control device 104 separately. Alternatively, the pattern generation device 102 can combine the first and second laser irradiation units together into a single file or layer prior to sending the pattern information to the control device 104.

Figure 10:
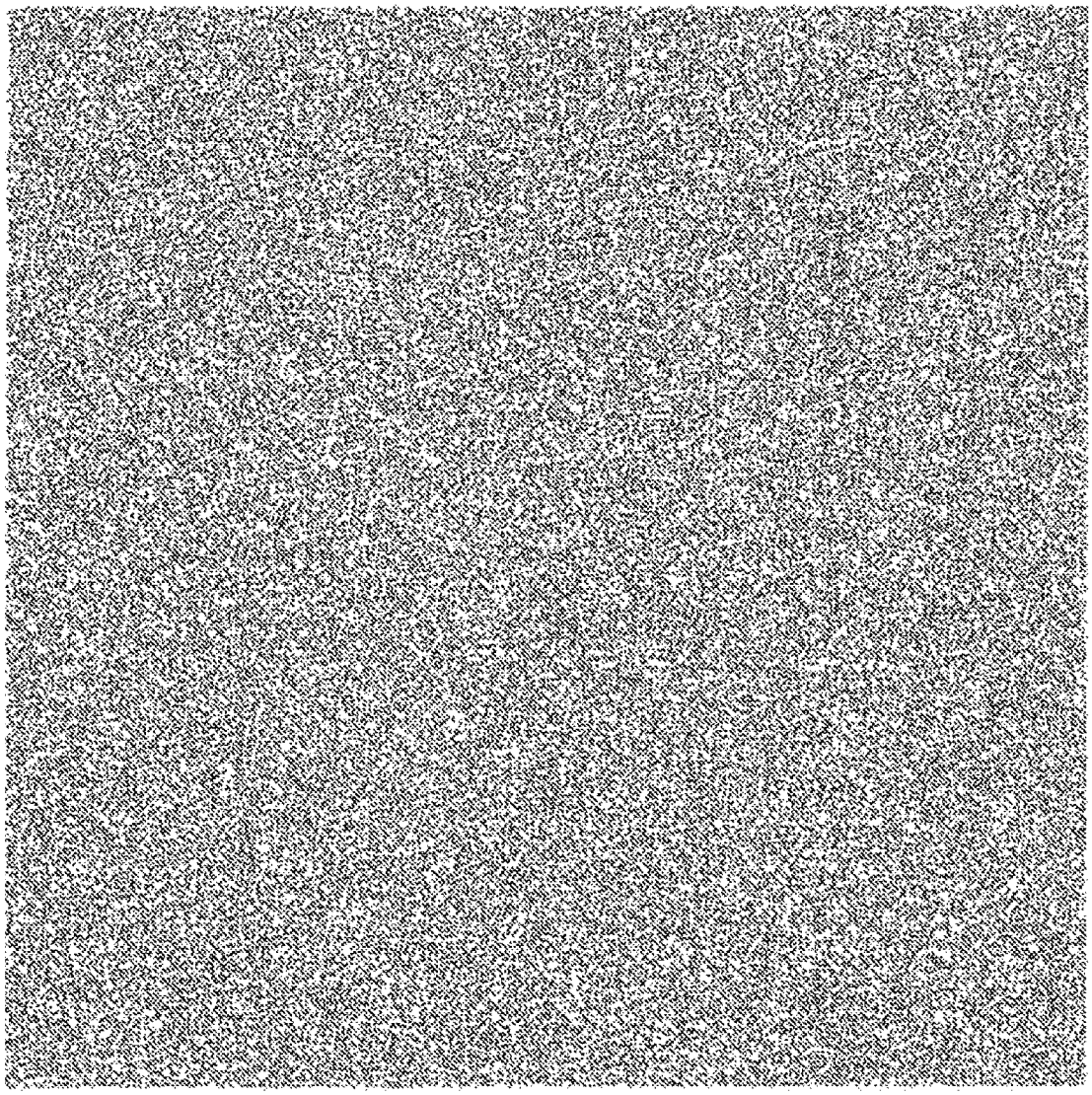
FIGS. 10 and 11 illustrate various pattern generated for processing a surface of a fabric according to exemplary embodiments.
Figure 11:
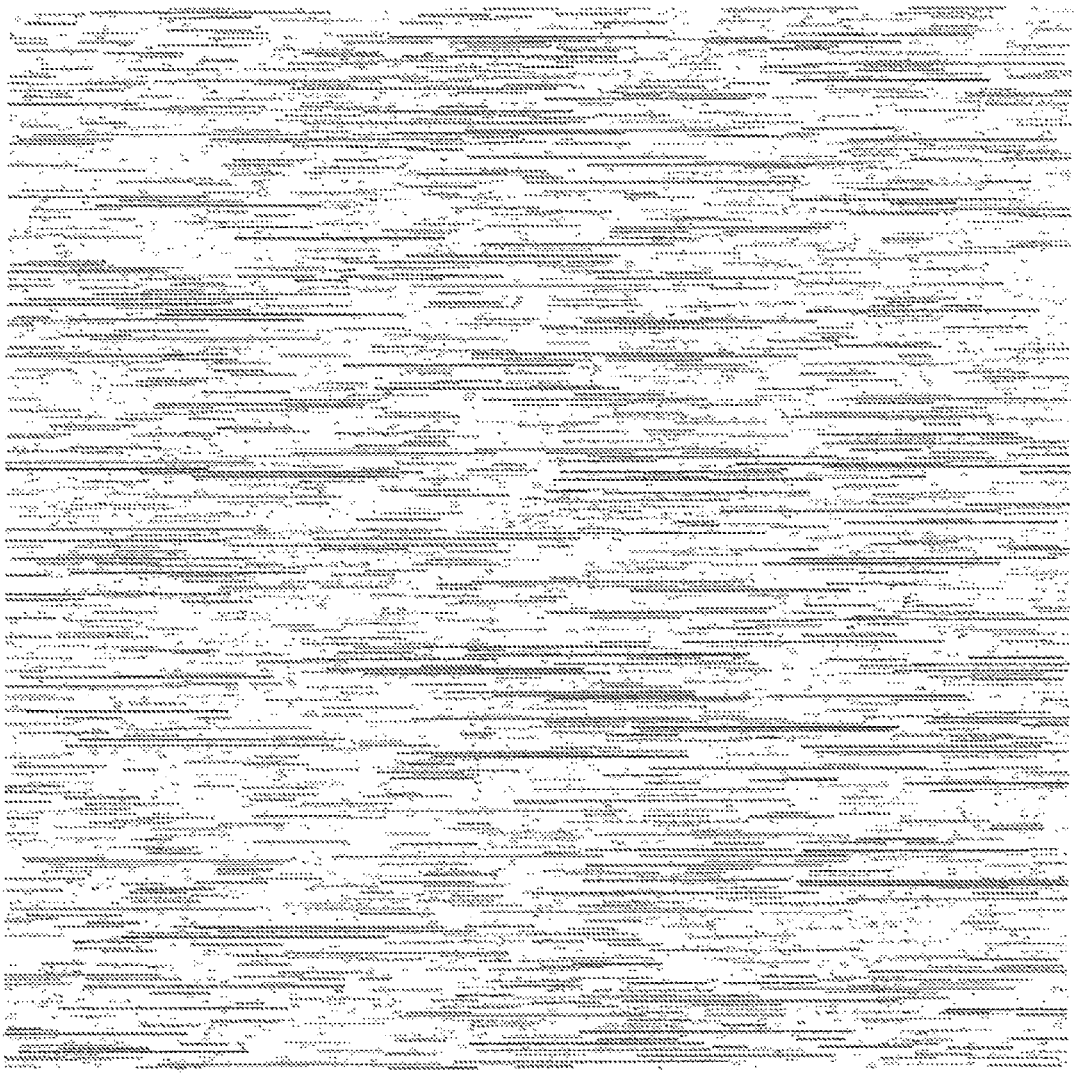
Figure 13:
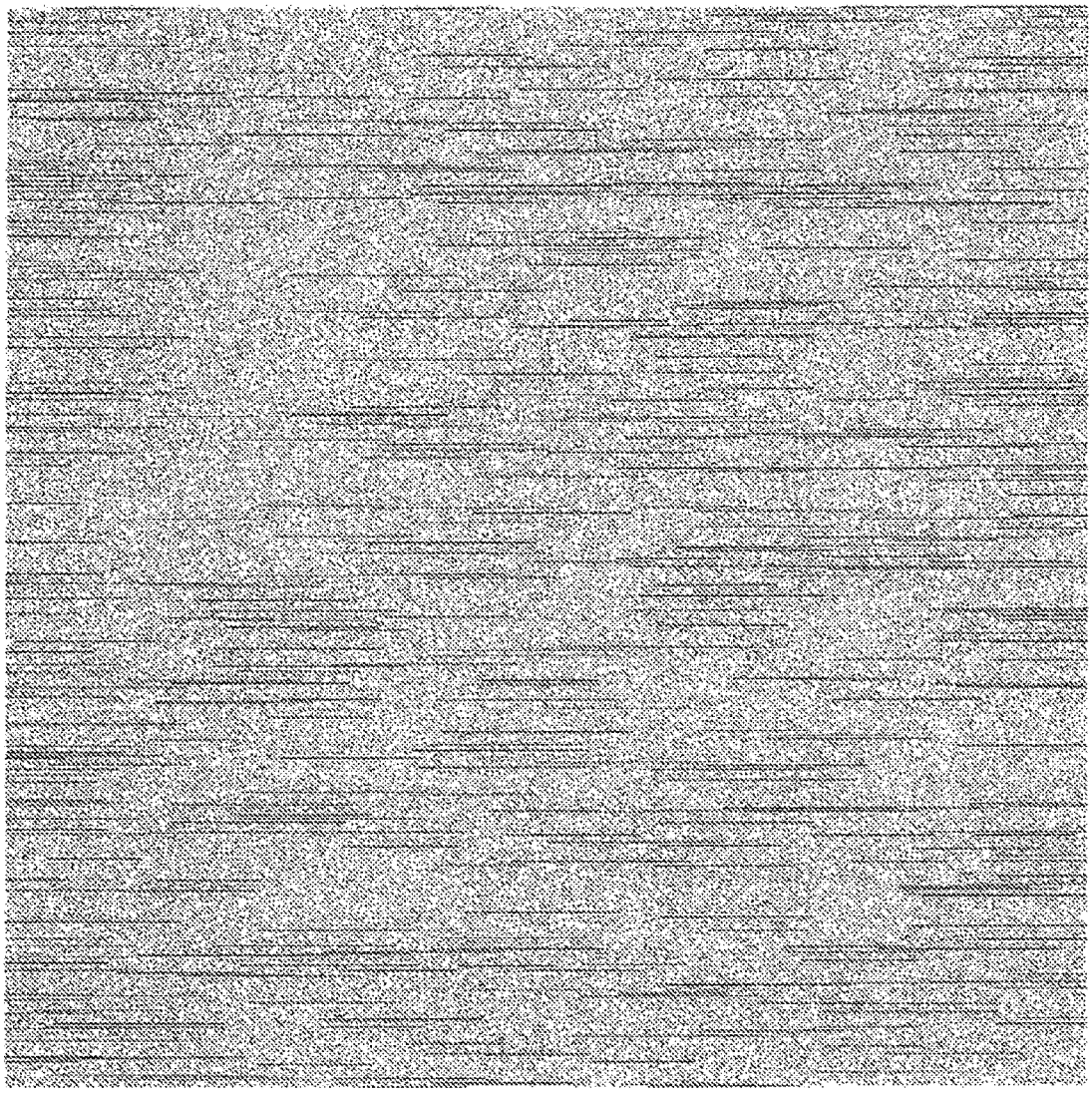
FIG. 13 illustrates another exemplary pattern generated for processing a surface of a fabric according to exemplary embodiments.
Figure 14:
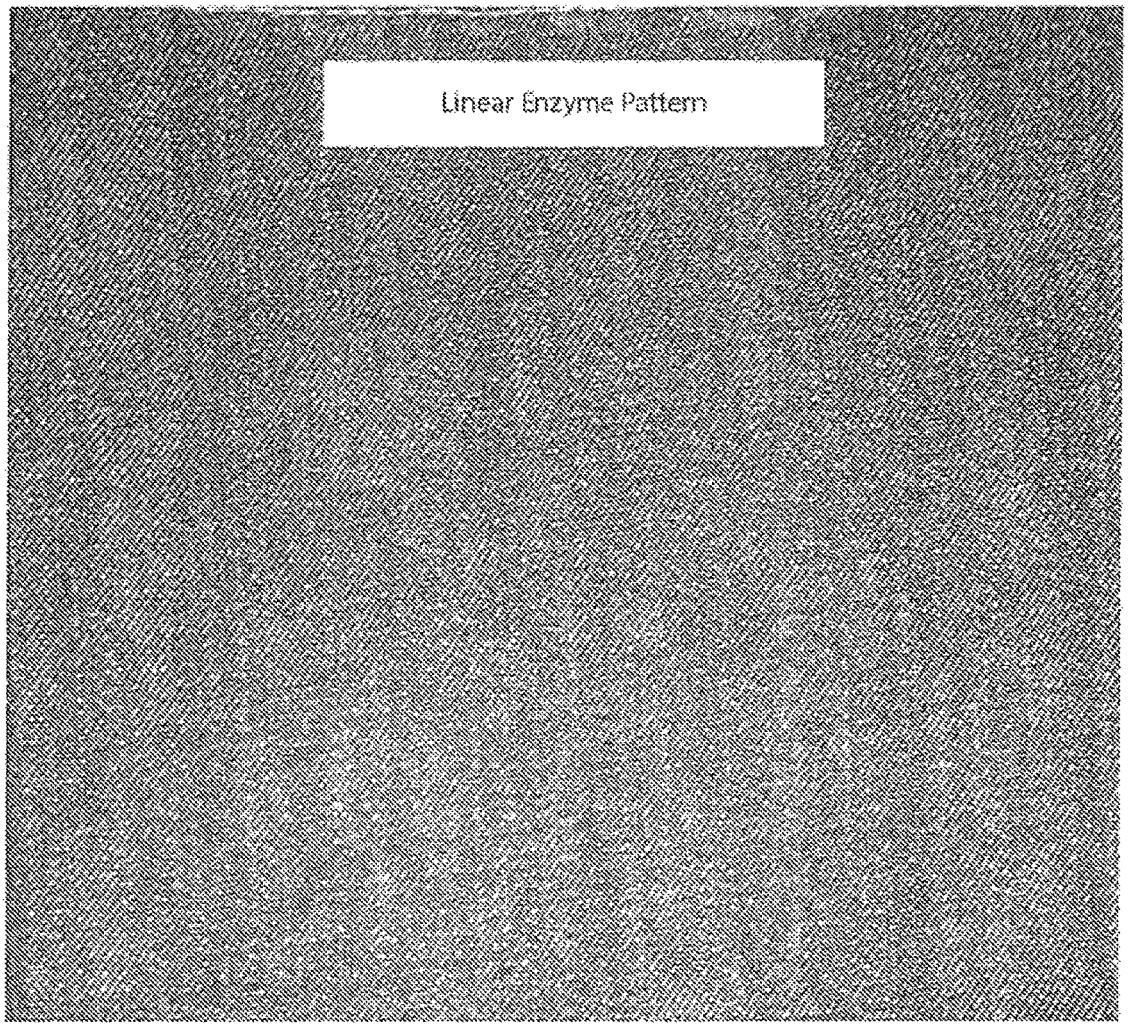
FIGS. 14-16 illustrates fabric surfaces created when the surface of a fabric is processed using the various exemplary patterns according to exemplary embodiments.
Figure 15:
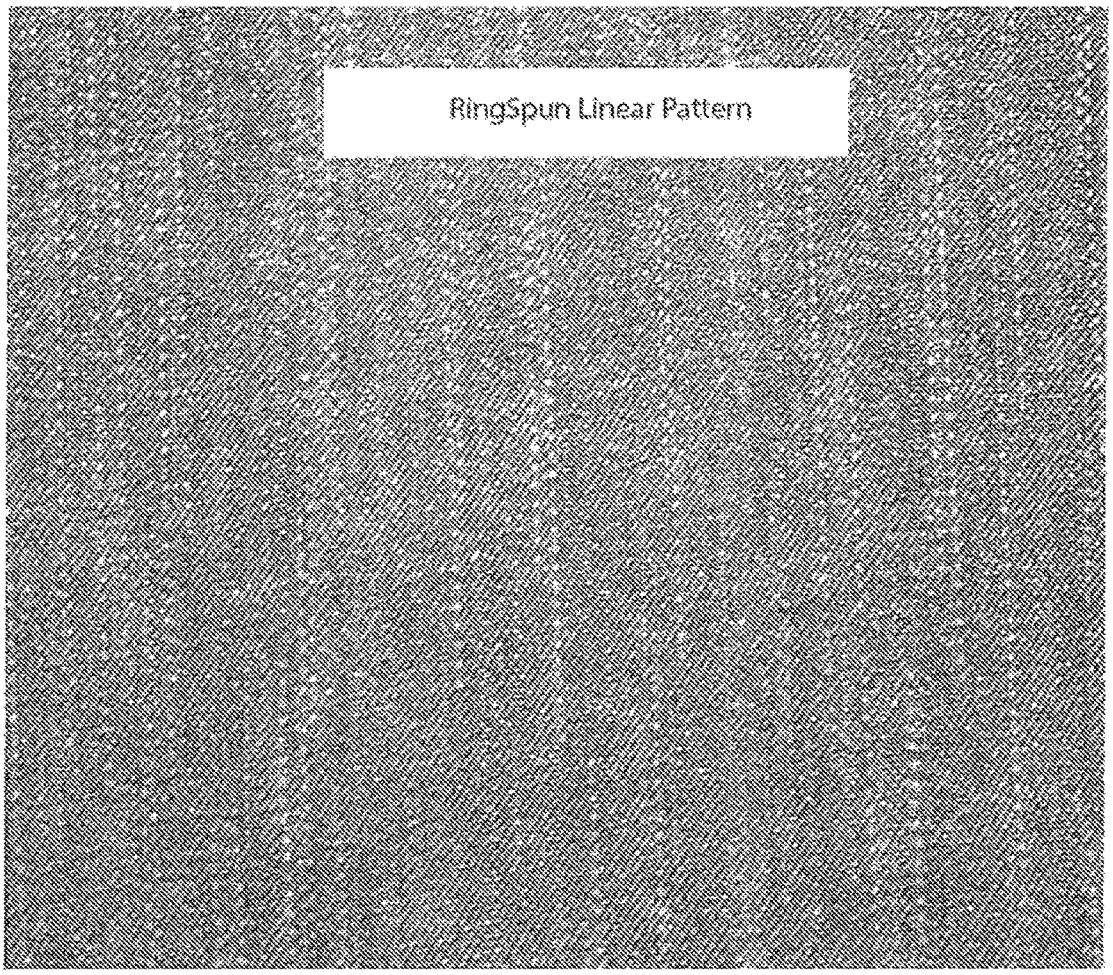
Figure 16:
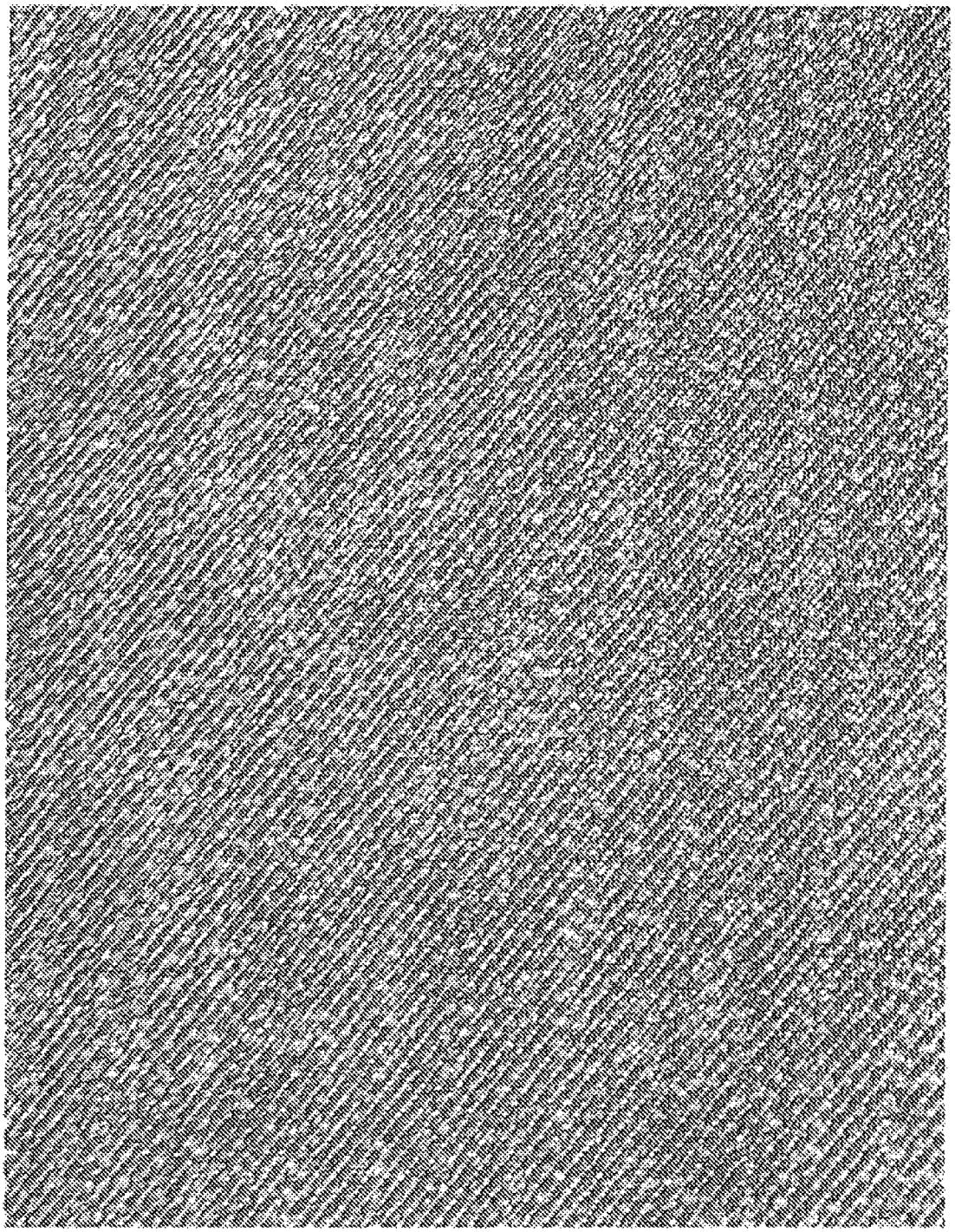

The method of generating a pattern image described above can be used to generate various types of patterns to be processed within a surface of a fabric. For example, a generated pattern image for a stonewash and enzyme pattern is illustrated in FIG. 10 and a resulting surface of a fabric after the surface has been processed using the pattern image of FIG. 10 is illustrated in FIG. 14. A generated pattern image for a ring spun pattern is illustrated in FIG. 11 and a resulting surface of a fabric after the surface has been lased using the pattern image of FIG. 11 is illustrated in FIG. 15. It is noted that the ring spun pattern can be lased upon a conventional denim material such as inexpensive open ended denim to create a pattern that replicates the appearance of expensive ring spun or loomed woven fabric. A generated pattern image for a combination of a stonewash enzyme pattern and a ring spun pattern is illustrated in FIG. 13 and a resulting surface of a fabric after the surface has been processed using the pattern image of FIG. 13 to form a lased pattern is illustrated in FIG. 16.

The ring spun pattern can be generated by defining the laser irradiation unit to have the shape of a line where various parameters of the line (e.g., laser irradiation unit density, discontinuity, dye removal) can be selected. In an exemplary embodiment discussed in greater detail below in connection with FIG. 23, a minimum line width, a maximum line width, a minimum line length, and a maximum line length can be selected. Various lines having variable widths and lengths may be selected. Alternatively, a single line width value and singe line length value (rather than a range) can be inputted.

Multiple lines of different lengths may be included within a ring spun pattern image. The densities of the respective lines may be the same or different from one another, and the positioning of the lines can be randomly determined. For example, when a laser irradiation unit density is selected, a random number of lines are selected such that the total number of pixels associated with laser irradiation units corresponds to the selected density. Then the total number of lines and the number of lines of each different length are selected to approximate the total number of pixels to include the laser irradiation units.

In an exemplary embodiment, the placement of each randomly determined line within the pattern area is performed by determining the probability whether a row within the pattern area will include a line. When it is determined that the row does not get a line, the next adjacent row is checked to determine the probability of whether the row should include a line. When it is determined that a row does get a line, a line is randomly arranged within the row of the pattern area, and a determination is made whether the next row gets a line.

When an overlap parameter is on (or checked at the pattern generation interface), the overlap count is incremented for each pixel that overlaps another line. When the overlap count exceeds a predetermined threshold, a line is not placed within that row. In addition, when another line is within a minimum number of skip pixels from the left or right of the line, it is skipped.

Figure 12:
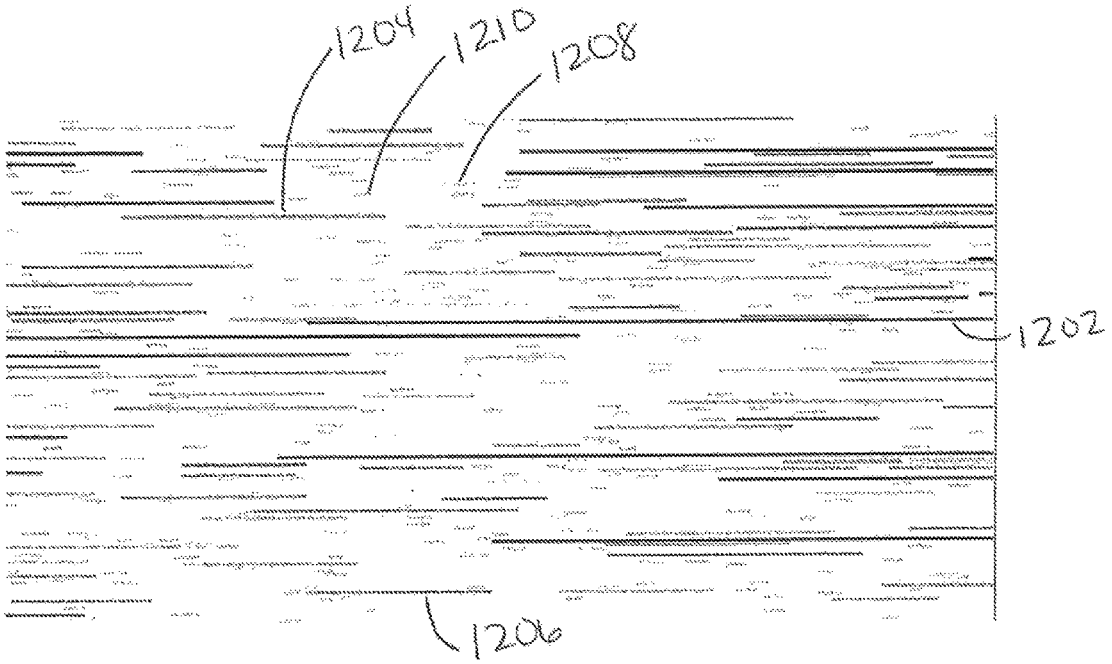
FIG. 12 illustrates a magnified portion of another exemplary pattern generated for processing a surface of a fabric according to an exemplary embodiment.

For example, FIG. 12 illustrates a magnified portion of the ring spun pattern image illustrated in FIG. 11. A first laser irradiation unit area 1202 is selected to have a first length, a second irradiation unit area 1204 is selected to have a second length that is less than the first length, a third irradiation unit area 1206 is selected to have a third length that is less than the second length, a fourth irradiation unit area 1208 is selected to have a fourth length that is less than the third length, and a fifth irradiation unit area 1210 is selected to have a fifth length that is less than the fourth length. While each of the irradiation unit areas 1202, 1204, 1206, 1208, 1210 appear to have the same width, one of ordinary skill in the art reading this specification will recognize that a variable width can also be utilized. One or more dye removal values can be selected for the laser irradiation units within a single line. In an exemplary embodiment, each different laser irradiation unit area can be created simultaneously within the pattern area. For example, a plurality of different lines having different lengths can be provided within the pattern area at the same time. Alternatively, each different laser irradiation unit can be provided within the pattern area at a different time, e.g., consecutively.

In an exemplary embodiment, when the surface of the fabric is processed based on the ring spun pattern, the frequency of the laser can be reduced at the laser itself. Specifically, separate from the identified parameters associated with the image created at the pattern generating device, the frequency of the laser may be reduced whereby the pattern lased on the surface of the fabric has gaps at locations corresponding to unbroken lines of the pattern image. Due to the reduction in frequency of the laser beam, the resulting pattern lased onto the surface of the fabric includes non-processed portions (or discontinuities) between processed portions when a line within the pattern exceeds a predetermined length. All of the elements that are less than the predetermined length are processed without gaps such that the resulting pattern on the surface of the fabric directly corresponds to the pattern image generated at the pattern generation device 102. Laser frequency reduction may be an effective way to increase processing speed to create the pattern with "gaps" on the surface of the fabric because rather than having to process each pixel individually to create an image having non-processed portions (gaps) between adjacent processed portions, a single line within the pattern image can be processed to create the same pattern as the image, but having non-processed portions (discontinuities) caused by the laser frequency reduction.

When two or more different patterns overlap within the same pattern area, for example, as illustrated in FIG. 13, where a stonewash enzyme pattern overlaps a ring spun pattern, different dye removal values can be identified for each pattern. For example, a first dye removal value or range of dye removal values can be identified with first laser irradiation units associated with a first pattern image and a second dye removal value or range of dye removal values can be identified with second laser irradiation units associated with a second pattern image. In an exemplary embodiment, the first pattern image can be a stonewash enzyme pattern and the second pattern image can be a ring spun pattern, where the first range of dye removal values associated with the stonewash enzyme pattern can be less than the second range of dye removal values associated with the ring spun pattern and vice versa. Alternatively, the same dye removal values can be identified for both pattern images.

Figure 22:
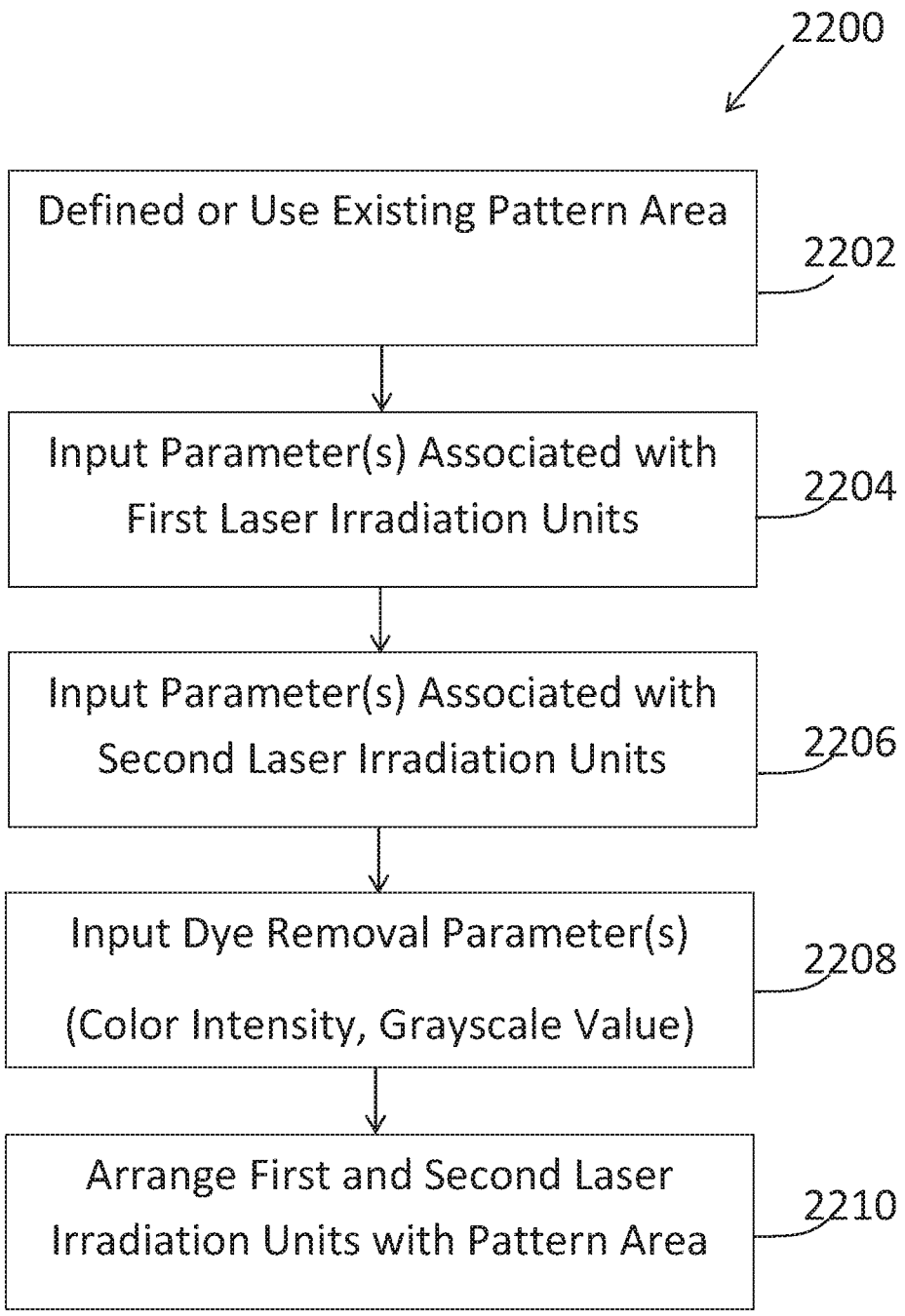
FIG. 22 illustrates a flow chart of an exemplary method of generating a pattern for processing a surface of a fabric according to another exemplary embodiment.

In an alternative embodiment, when two or more different patterns are arranged within the same pattern area, all of the patterns can be created on a pixel-by-pixel basis using a computer-aided design program, such as ADOBE PHOTOSHOP®, customized to practice the invention as described herein. For example, FIG. 22 illustrates a flow chart of an exemplary method 2200 for generating a pattern used to process a surface of a fabric through laser irradiation. The method will be discussed with reference to the exemplary laser patterning systems 100 and 200 illustrated in FIGS. 1 and 2. However, the method can be implemented with any suitable laser patterning system. In addition, although FIG. 22 depicts steps performed in a particular order for purposes of illustration and discussion, the methods discussed herein are not limited to any particular order or arrangement. One skilled in the art, using the disclosures provided herein, will appreciate that various steps of the methods can be omitted, rearranged, combined, and/or adapted in various ways.

At 2202, a pattern area is defined. The pattern area is configured to define a predetermined boundary area in which various laser irradiation pattern images can be arranged within the pattern area such that a laser processes a surface of a fabric to include a pattern based on the pattern images arranged within the pattern area. For example, a user defines a pattern area within a pattern generation interface such as an interface illustrated in FIG. 23 at the pattern generating device 102. However, any interface may be implemented. The pattern area includes a two-dimensional array of pixels and can correspond to various field sizes such as 10×10, 20×20, 50×50, etc. where the field size may be in inches, millimeters, or some other unit of measurement. The pattern area can be defined by the user through manipulation at the pattern generation interface to have any shape such as linear, square, rectangular, circular, oval, hexagonal, etc.

In an exemplary embodiment, the defined pattern area can be repeated along the length and width of the fabric such that each of the defined pattern areas are aligned and arranged adjacent to each other. For example, fabric is frequently stored or created on rolls, and implementation of the invention allows the pattern to be applied across the width of a fabric roll and also segmented along its length, thus allowing the entire surface of the fabric roll to be treated. Further, due to the flexibility of use of pattern creation device 102, different patterns may be created and applied across the fabric roll. The individual patterns may be applied, for example, either through irradiation by a single laser, or through multiple lasers, each irradiating a defined portion of the fabric roll.

At 2204, at least one parameter associated with a first laser irradiation pattern image is defined. A user can input the one or more parameters associated with the first laser irradiation pattern image using the pattern generation interface at the pattern generating device 102. In an exemplary embodiment, the first laser irradiation pattern image is associated with a stonewash and enzyme pattern. For example, the first laser irradiation pattern image can include a plurality of first laser irradiation units randomly arranged within the pattern area at a first laser irradiation density. The user can define one or more parameters associated with the first laser irradiation pattern image, for example, a first laser irradiation unit area and a first laser irradiation unit density associated with the first laser irradiation pattern image. However, one of ordinary skill in the art reading this specification will recognize that the first laser irradiation pattern image can be any type of laser irradiation pattern including surface processing patterns such as whiskers, sandblasting, etc. as well as graphic patterns such as camouflage, pin stripes, or other graphic elements such as a star or flower.

One parameter that can be defined is the probability that a pixel within the pattern area is randomly assigned a laser irradiation unit. The probability that a pixel is selected to be assigned to a laser irradiation unit corresponds to the desired density of the laser irradiation units, referred to as the laser irradiation unit density. For example, the higher the specified probability level, the greater the number of pixels that are assigned a laser irradiation unit within the pattern area, thereby creating a pattern image in which the laser irradiation units are spaced closer together. The lower the defined probability, the smaller the number of pixels that are assigned a laser irradiation unit within the pattern area, thereby creating a pattern where the laser irradiation units are spaced further apart. In an exemplary embodiment, if a user defines the probability to be 50%, approximately 50% of the pixels within the pattern area will be assigned a laser irradiation unit.

Another parameter that can be defined is the dye removal value used within the pattern area. Dye removal may be represented, for example, by grayscale value, color intensity, or color. For example, a minimum grayscale level and/or a maximum grayscale level can be defined. The grayscale levels are associated with the number of grayscale levels values available. For example, when there are 256 possible grayscale values, the minimum and/or maximum grayscale levels can range from 0 to 255, where 0 represents the maximum grayscale value (e.g., black) and 255 represents the minimum grayscale value (e.g., white) (or vice versa). When a range is defined and the pattern is generated, the resulting first laser irradiation pattern includes laser irradiation units randomly selected from within the range between the defined minimum and maximum color levels.

A parameter associated with a minimum number of pixels skipped between the laser irradiation units can also be defined for the first laser irradiation pattern. The parameter associated with a minimum number of pixels skipped can be a vertical and/or a horizontal parameter. The vertical parameter is associated with a minimum number of adjacent pixels between each laser irradiation unit of the first laser irradiation within a column. The horizontal parameter is associated with a minimum number of adjacent pixels between each laser irradiation unit of the first laser irradiation within a row. The minimum pixels skipped need not be the same for both the horizontal and vertical parameters. It is noted that the parameter associated with a minimum number of pixels skipped between the laser irradiation units is optional. Further, the user may input a maximum number of pixels skipped in both the horizontal and vertical directions. Utilizing a maximum number of skipped pixels in the horizontal and vertical directions allows the resulting graphic to achieve a more random-looking appearance. Those skilled in the art reading this specification will appreciate that the maximum pixels skipped need not be the same for the horizontal and vertical parameters.

An exemplary method of carrying out embodiments of the invention and defining parameters such as involved in steps 2204 and 2206 of FIG. 22 involve using ADOBE PHOTOSHOP® modified, such as with a customized plug-in application, which is referred to in certain figures as "Shotgun," and will now be described in connection with FIG. 23 and FIGS. 31-34. The modifications to ADOBE PHOTOSHOP® and other similar programs, and in particular the programming of customized plug-ins, are within the purview of those of ordinary skill in the art having reference to this specification. Although steps are set out in particular orders in the flowcharts of FIGS. 31-34, the methods described herein are not limited to the particular order or arrangements of those flowcharts. One skilled in the art, using the disclosures provided herein, will appreciate that various steps of the methods can be omitted, rearranged, combined, and/or adapted in various ways.

Figure 31:
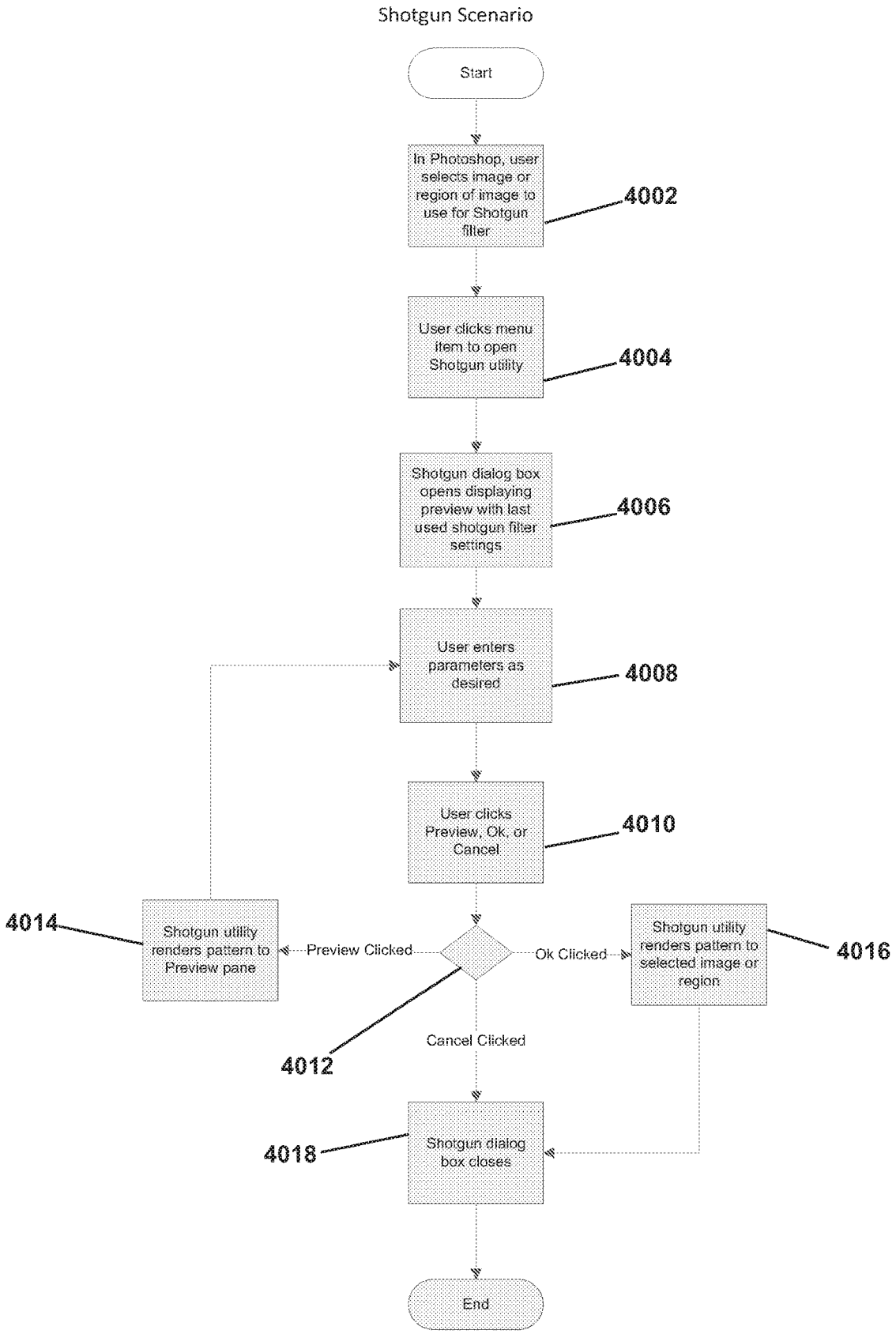
FIG. 31 illustrates a flowchart for carrying out an exemplary embodiment of the present invention.

Referring initially to FIG. 31, using ADOBE PHOTOSHOP® with an appropriate plug-in a user selects an image or a region of an image in step 4002 and selects the appropriate menu item to open the interface in step 4004. FIG. 23 is a screenshot of an interface in the form of a dialog box illustrating an image of a pattern (or a "pattern image") to be laser irradiated (lased) and the associated parameters when using a customized (plug-in modified) ADOBE PHOTOSHOP®. The dialog box opens displaying a preview of the last used filter settings in step 4006.

At step 4008 of FIG. 31, the user enters parameters of the desired first laser irradiation pattern. Examples of those parameters of step 4008 are best shown in the dialog box of FIG. 23. In FIG. 23, the left hand side of the interface (dialog box) contains a representation of the pattern as image "I" being created that ultimately will be used to irradiate denim fabric. The image "I" represents the ring spun pattern, although any sort of image may be displayed by the interface on an appropriate computer display or the like. The right hand side of the interface of FIG. 23 illustrates the parameters that may be set or specified by the user in step 4008 of FIG. 31 for creating the image "I". The parameters selected in step 4008 are discussed in further detail below.

After the parameters are selected, in steps 4010 and 4012 the user makes a decision to select one of the Preview, OK, or Cancel buttons of the dialog box of FIG. 23. Selection of the "Preview" button (step 4014) allows the user to initiate the program, provided appropriate parameters are identified to create the image "I", so that the user can assess whether the pattern image "I" is acceptable or whether further modification is necessary (at step 4008) prior to lasing, for example, by selection of different or additional parameters. Selection of the "OK" button (step 4016) renders the pattern to the selected image or region, after which the dialog box is closed at 4018. Selection of the "Cancel" button in step 4012 closes the dialog box in step 4018, as shown in FIG. 23.

Figure 32:
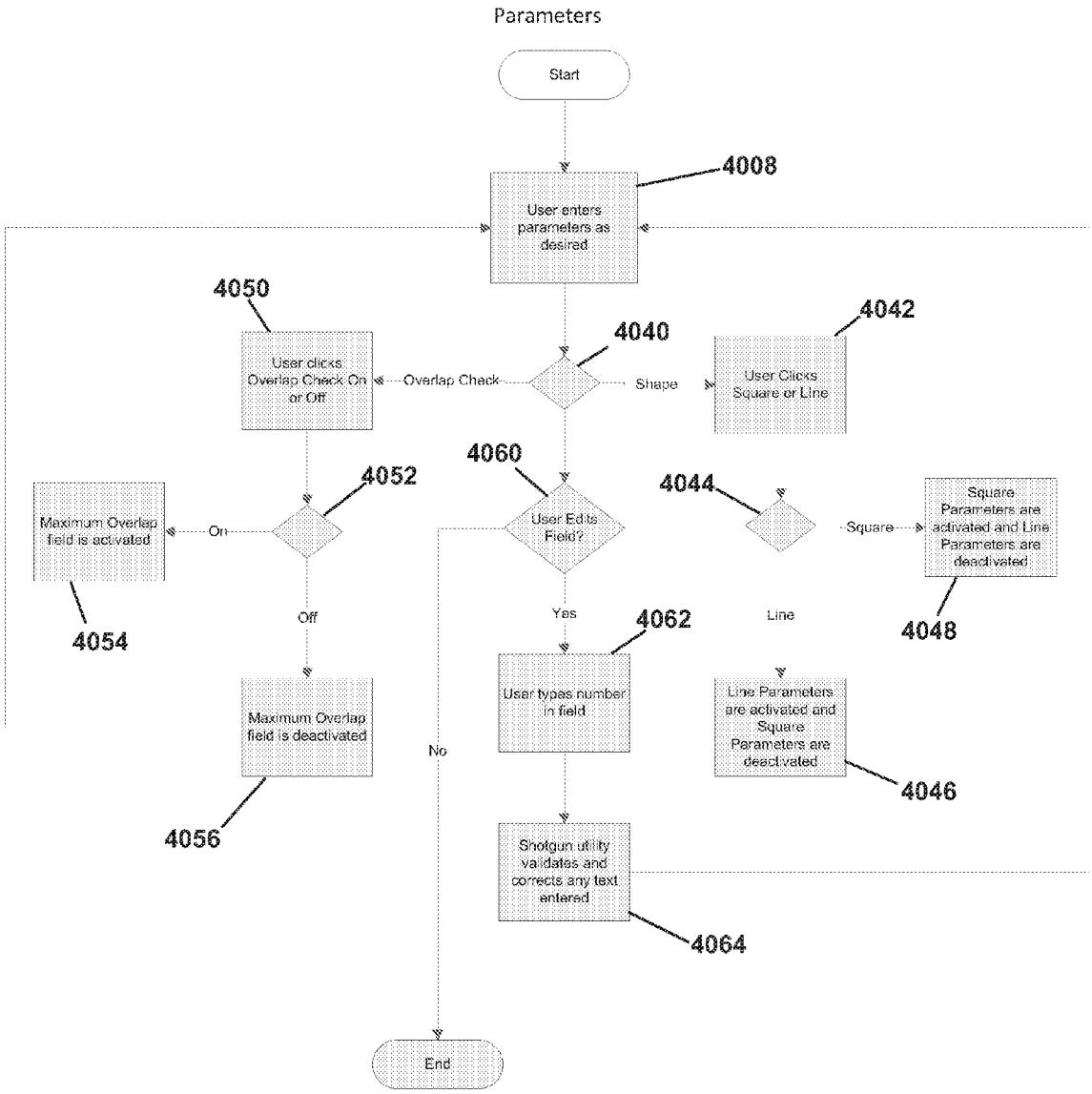
FIG. 32 illustrates a flowchart for carrying out an operation of FIG. 31.

As noted above, the user selects the parameters as desired in step 4008. FIG. 32 is a flowchart showing some of the decisions and parameters that may be involved in step 4008. The parameters include "common parameters" C, "shape" parameters S, and "line "parameters" L of the dialog box of FIG. 23. Among the common parameters "C" are probability, color scale, maximum and minimum skip, and overlap.

When initiating creation of an image, the user initially inputs the probability of a laser irradiation unit being irradiated (not shown in the flowcharts of FIG. 31 or 32). In FIG. 23 the probability has been set at 80%. The user also inputs the color range from a minimum intensity to a maximum intensity to determine how many of a possible 255 grayscale values should be included in the image. In FIG. 23 the color range is set at a color min of 0, which corresponds to a black grayscale value and a color max of 100, which corresponds to a grayish shade grayscale value. The total color range is 0 to 255.

Also among the common parameters C is minimum skip and maximum skip. The user may set the minimum and maximum skips between laser irradiation units, both in the horizontal and vertical directions. In FIG. 23, the minimum skip has been set at 1 pixel in both the horizontal and vertical directions, and the maximum skip is set at 6 pixels in the horizontal direction and 10 pixels in the vertical direction.

Referring to the flowchart of FIG. 32, one of the decisions that may be made at step 404 is to proceed to step 4050 for checking (or unchecking) the "Overlap Check." The Overlap Check allows the user to set the overlap between laser irradiation units. If a decision is made at step 4052 to turn the Overlap Check on, then at 4054 the maximum overlap value is selected. In FIG. 23 the overlap has been checked and the maximum overlap has been set to 0% (step 4054), which will result in no overlap. Alternatively, if the decision made at step 4052 is to turn the Overlap Check off, in step 4056 the maximum overlap field is deactivated so that no maximum overlap is assigned. After step 4054 or 4056, the flowchart returns back to step 4008 for the user to enter additional parameters as desired.

The user may decide at step 4040 to address the shape parameters. At step 4042, the user clicks either the "Square" option or the "Line" option in field "S" of FIG. 23. For the purposes of discussion, selection is illustrated as being made between a square shape and a line, although it should be understood that other shapes may be used and included in the dialog box of FIG. 23. Further, the dialog box may be provided with a customization selection box to allow selection of alternative shapes and dimensions for those alternative shapes.

If the decision 4044 is to select the line shape, the flowchart proceeds to step 4046 where the line parameters are activated and the square parameters (e.g., shot) are deactivated. On the other hand, if the decision 4044 is to select the square shape, the flowchart proceeds to step 4046 where the square parameters are activated and the line parameters are deactivated. The square parameters are discussed below in greater detail with reference to FIG. 33. The line parameters are discussed below in greater detail with reference to FIG. 34. After the line or square parameters are selected, the flowchart returns to step 4008 and decision 4040 again.

The user decides whether to edit fields at step 4060. If a "yes" decision is made to edit fields, the user edits a field by typing a new value, and the utility validates and corrects any text entered at 4064 before returning to step 4008. On the other hand, if a "no" decision is made at 4060 (i.e., to not edit any field), then the process ends. Optionally, this flowchart may be repeated separately to define the parameters associated with different laser irradiation patterns, e.g., the parameters associated with the first laser irradiation pattern (step 2204 of FIG. 22) and the parameters associated with the second laser irradiation pattern (step 2206 of FIG. 22).

Figure 33:
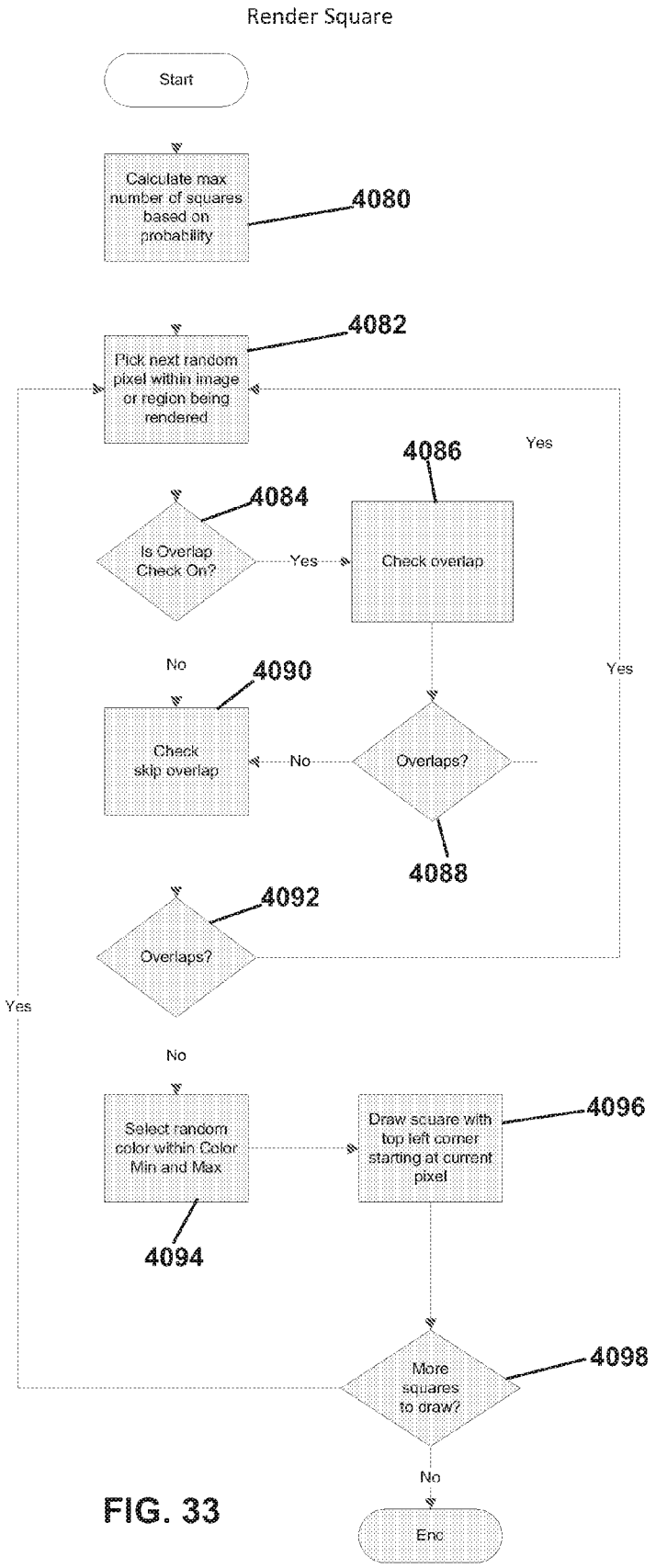
FIG. 33 illustrates a flowchart of logic for carrying out another exemplary embodiment of the present invention.
Figure 34:
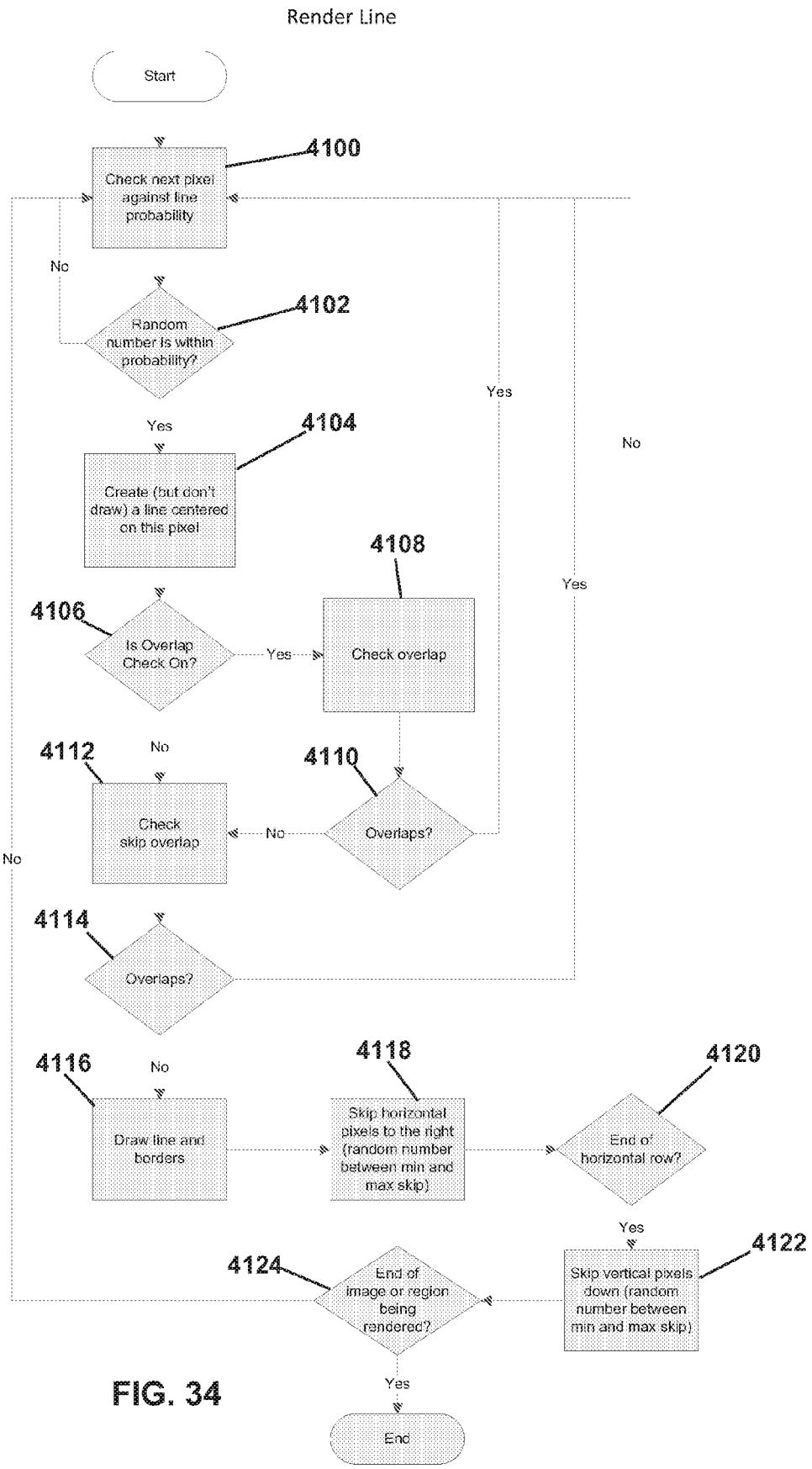
FIG. 34 illustrates a flowchart of logic for carrying out still another exemplary embodiment of the present invention.

FIGS. 33 and 34 are flowcharts of software logic of processing parameters input into the graphical user interface in the case of a square and a line, respectively. A programmer of ordinary skill in the art will understand and be able to implement software for carrying out the logic.

In FIG. 23 the shape has been set for creating a line (step 4046 of FIG. 32) as opposed to a square (step 4048 of FIG. 32). Line shapes are generally preferred over square and other polygonal shapes for designing ring spun patterns, whereas polygonal shapes are generally preferred over line shapes for designing enzyme or stonewashed patterns.

In FIG. 23, the minimum width has been set at 1 pixel, as has the maximum width. The minimum line length has been set at 50 pixels and the maximum length at 200 pixels. The line parameters L also include the number of pixels on (for irradiation) and the gap (or pixels off) between pixels on the pattern generation interface (for no irradiation). In FIG. 23, the user has selected 2 pixels on with a gap of 2 pixels there between. Accordingly, a line of 200 pixels length will appear as alternating 50 2-pixel length lines alternating with 50 2-pixel length gaps.

The user may also select whether the irradiation features are to have a white border. FIG. 23 illustrates an interface in which the white border has been turned on, with the probability being set to 10%, with a width of 1 pixel, and the white border being defined by pixels and not a line. Thus, approximately 10% of the irradiated lines will have a border.

Once the user has input the parameters C, S and L, the Preview button may be activated to cause the image "I" to appear on the associated display. The user may review the resulting image and decide whether the image is satisfactory. The user, through use of the preview button and subsequent editing of the parameters, may thus manipulate the various parameters and ascertain the effect, if any, caused by varying parameters. Image "I" allows the user to have some level of confidence that the pattern image, when irradiated onto the fabric surface, will be acceptable. Ultimately, suitability of the pattern is based on the lased fabric. If the pattern lased on the fabric is not acceptable to the user, the user returns to the interface to modify the lasing parameters.

The "Preview" and lasing steps can be practiced in an iterative manner, wherein after a first pattern image is previewed then lased onto the fabric surface to form the pattern, the user applies objective or subjective criteria to determine whether the lased pattern is acceptable. The lased pattern is not always identical to the pattern image appearing on the user interface. Differences between the pattern image and the pattern lased on the fabric might result from, for example, inherent deficiencies in the laser or laser process itself. For example, depending upon the laser equipment selected, a pattern image and the corresponding pattern lased onto the fabric surface may not appear the same to the user. Accordingly, the various parameters selected (e.g., pixels-on, gap, skip, width, length, etc.) may be increased or decreased during the iterative parameter input process (e.g., between lasing steps) to alter the lased pattern and provide the desired lased pattern result.

In an exemplary embodiment, when the minimum vertical "skip" parameter is defined to be two, the minimum number of pixels skipped within a column will be at least two where the laser irradiation units will be randomly arranged within the pattern area such that at least two pixels separate each laser irradiation unit within a single column. Similarly, when the minimum horizontal skip parameter is defined to be two, the minimum number of pixels skipped within a row will be at least two where the laser irradiation units will be randomly arranged within the pattern area such that at least two pixels separate each laser irradiation unit within a single row. As another exemplary embodiment, the minimum (or maximum) number of pixels skipped can be associated with laser irradiation units of particular color intensity values, i.e., so that pixel skipping is performed with respect to one or more color intensity values but is not performed with respect to other color intensity values.

In an alternative embodiment, the minimum number of pixels skipped can be associated with laser irradiation units of the same color intensity value where laser irradiation units associated with different color intensity values can be arranged between laser irradiation units of the same color intensity value. For example, when the minimum vertical skip parameter is defined to be two, the minimum number of pixels skipped between two first laser irradiation units having a first color intensity value within a column will be at least two. One or more second laser irradiation units having a second color intensity value may be arranged between the first laser irradiation units of the first color intensity. In other words, the user may select the minimum number of pixels to be skipped between laser irradiation units of the same color intensity. Alternatively, grayscale value or color may be substituted for color intensity.

A parameter associated with an overlap variable can be defined such that a determination of whether laser irradiation units overlap within the pattern area is performed. When an overlap determination is to be performed, the user can define a threshold level of acceptable overlap percentage. For example, if the user specifies that up to 25% overlap is acceptable, when the first laser irradiation pattern is arranged within the pattern area, the number of overlapping laser irradiation units of different color levels will be randomly arranged such that up to approximately 25% of the different irradiation units overlap. In other words, a pixel can be associated with both a first laser irradiation unit color level and a second laser irradiation unit having a different color level up to approximately 25% of the time due to the random arrangement within the pattern area of each laser irradiation unit associated with each color intensity value.

Additionally, overlap may be used, for example, where multiple layers are created, each with its own pattern, and the layers are merged into a single layer, such as when using ADOBE PHOTOSHOP® with a customized plug-in. When using multiple layers, one layer may, for example, simulate the ring spun pattern and another layer may simulate the enzyme wash pattern.

Another parameter that can be defined is the shape of each laser irradiation unit associated with the first laser irradiation pattern. For example, when the first laser irradiation pattern is a stone-wash and enzyme pattern, the laser irradiation unit shape can be selected to be a square and a "shot size" can be input. The shot size can include various areas. In an exemplary embodiment, a parameter associated with the shot size can be input as an area of 1×1, 2×2, 3×3, 4×4, or 5×5 pixels square. For example, when a first shot size of 1 is selected, the associated first laser irradiation unit area identified within the pattern area is 1×1. When a second shot size of 5 is selected, the associated second laser irradiation unit area identified within the pattern area is 5×5.

At 2206, at least one parameter associated with a second laser irradiation pattern image different from the first laser irradiation pattern image is defined. The parameters of the second laser irradiation pattern image can be defined in step 2206 in the same manner described above for defining parameters associated with the first laser irradiation pattern image in step 2204. The user can input the parameter(s) associated with the second laser irradiation pattern image using the pattern generation interface at the pattern generating device 102. In an exemplary embodiment, the second laser irradiation pattern image simulates a ring spun pattern. For example, the second laser irradiation pattern image can include a plurality of second laser irradiation units where each of the second laser irradiation units has a shape corresponding to a line having a length greater than a width. The plurality of second laser irradiation units can include one or more discontinuity elements and the plurality of second laser irradiation units are arranged to have a second laser irradiation density. The user can define one or more parameters associated with the second laser irradiation pattern image to define the second laser irradiation units, the regularity of the discontinuity elements, and/or the density of the plurality of the second laser irradiation units arranged within the pattern area. However, one of ordinary skill in the art reading this specification will recognize that the second laser irradiation pattern can be associated with a surface processing pattern such as whiskers, sandblasting, etc. or other graphic patterns such as camouflage or other graphic element.

For instance, parameters associated the shape of the second laser irradiation unit can be defined. In an exemplary embodiment, a minimum length, a maximum length, a minimum width, and a maximum width can be input. Based on those values, the resulting second laser irradiation units can be configured to be a line having a length greater than a width, wherein the length and width of each of the second laser irradiation units are randomly selected from the minimum and maximum defined length range and the minimum and maximum defined width range.

Another parameter associated with the second laser irradiation pattern is discontinuity parameter, which may include a gap within each second laser irradiation unit and/or a skip in the horizontal direction and/or vertical direction between second laser irradiation units. For example, a first value associated with a number of consecutive pixels "on" within each second laser irradiation unit can be defined. In an exemplary embodiment, when the number of consecutive "on" pixels of the second laser irradiation units is set at 10 and the number of consecutive "off" pixels is set at 2, the second laser irradiation pattern is created to include second laser irradiation units in the shape of lines having 10 consecutive pixels "on" alternating with 2 consecutive pixels "off".

When the second laser irradiation pattern is a ring spun pattern, the second laser irradiation units in combination with the discontinuity elements can visually recreate the irregular textured surface generated by the warp threads in traditional denim manufacturing. In an exemplary embodiment, the contrast between the second laser irradiation units and the discontinuity elements can correspond to the minimum and maximum color intensity values. For example, the second laser irradiation units can be selected to represent the maximum color intensity value (e.g., black) and the discontinuity elements can be selected to represent the minimum color intensity value (e.g., white), which results in a processed article where the second laser irradiation units are processed by the laser and the discontinuity elements are processed at a minimum value where the discontinuity elements are more visibly discernable due to the maximum laser processing of the fabric surrounding the discontinuity elements. However, one of ordinary skill in the art reading this specification will recognize that as long as the color intensity level of the second laser irradiation unit is selected to be different from the color intensity level of the discontinuity elements, the values selected may be within the range of selected gray scale values. Moreover, the second laser irradiation units may alternatively be selected to have a color intensity value greater than the discontinuity elements.

In addition, a parameter associated with the density of the second laser irradiation units can be defined. In an exemplary embodiment, a probability percentage in which a second laser irradiation unit is provided within a row of the pattern area is defined. The higher the probability percentage, the greater the number of second laser irradiation units randomly provided within a single row. The lower the probability percentage, the smaller the number of second laser irradiation units randomly provided within a single row. In addition, the higher the probability percentage, the smaller the number of rows between each of the second laser irradiation units. The lower the probability percentage, the greater the number of rows between each of the second laser irradiation units. In other words, when the percentage of probability is high, the density of the second laser irradiation units within the pattern area is greater such that more second laser irradiation units are arranged within the pattern area than when the percentage of probability is low.

A parameter associated with spacing between each of the second laser irradiation units can also be defined. For example, a vertical spacing parameter and/or a horizontal spacing parameter can be defined where the vertical spacing parameter and/or the horizontal spacing parameter relate(s) to a minimum number of adjacent pixels between each of the laser irradiation units of the second laser irradiation pattern within a column and/or a row of the pattern area, respectively. In an exemplary embodiment, when a vertical spacing parameter is defined to be three and a horizontal spacing parameter is defined to be five, the resulting pattern generated within the pattern area includes second laser irradiation units having a length greater than a width where at least three adjacent pixels separate (or space apart) each of the second laser irradiation units in a column direction and at least five adjacent pixels separate (or space apart) each of the second laser irradiation units in a single row. Further, the user may include a maximum number of laser irradiation units spaced in both the horizontal and vertical directions. Utilizing a maximum spacing between laser irradiation units in the horizontal and vertical directions allows the resulting graphic to achieve a more random-looking appearance. Those skilled in the art will appreciate that the maximum spacing parameter need not be the same for the horizontal and vertical orientations, and that the minimum spacing parameter likewise need not be the same in the horizontal and vertical orientations.

Moreover, one or more parameters associated with a white border for the second laser irradiation units can be defined. The border parameter may be defined to create various configurations depending upon the desired visual appearance of the second laser irradiation pattern. For example, a user can define a parameter where no border surrounds each of the second laser irradiation units such that the first laser irradiation pattern is adjacent to one or more sides of the second laser irradiation units.

Alternatively, a user can define one or more parameters associated with a border for at least one second laser irradiation unit. A border can be one or more pixels surrounding at least a portion of one second laser irradiation unit. The border can have a column parameter and/or a row parameter where a user defines a minimum number of pixels in the row and/or column directly adjacent to a side of one or more second laser irradiation units. When a border is selected, the border can be arranged on one or more sides of at least one second laser irradiation unit. In addition, the border can be selected to be solid (e.g., all one color intensity value) for the defined column and row parameters or various color intensity values randomly assigned within the column and row border parameters. This can be done in various ways. For example, when the border is selected to be solid, a predetermined border can be uniformly arranged corresponding to each of the second laser irradiation units.

Figure 24:
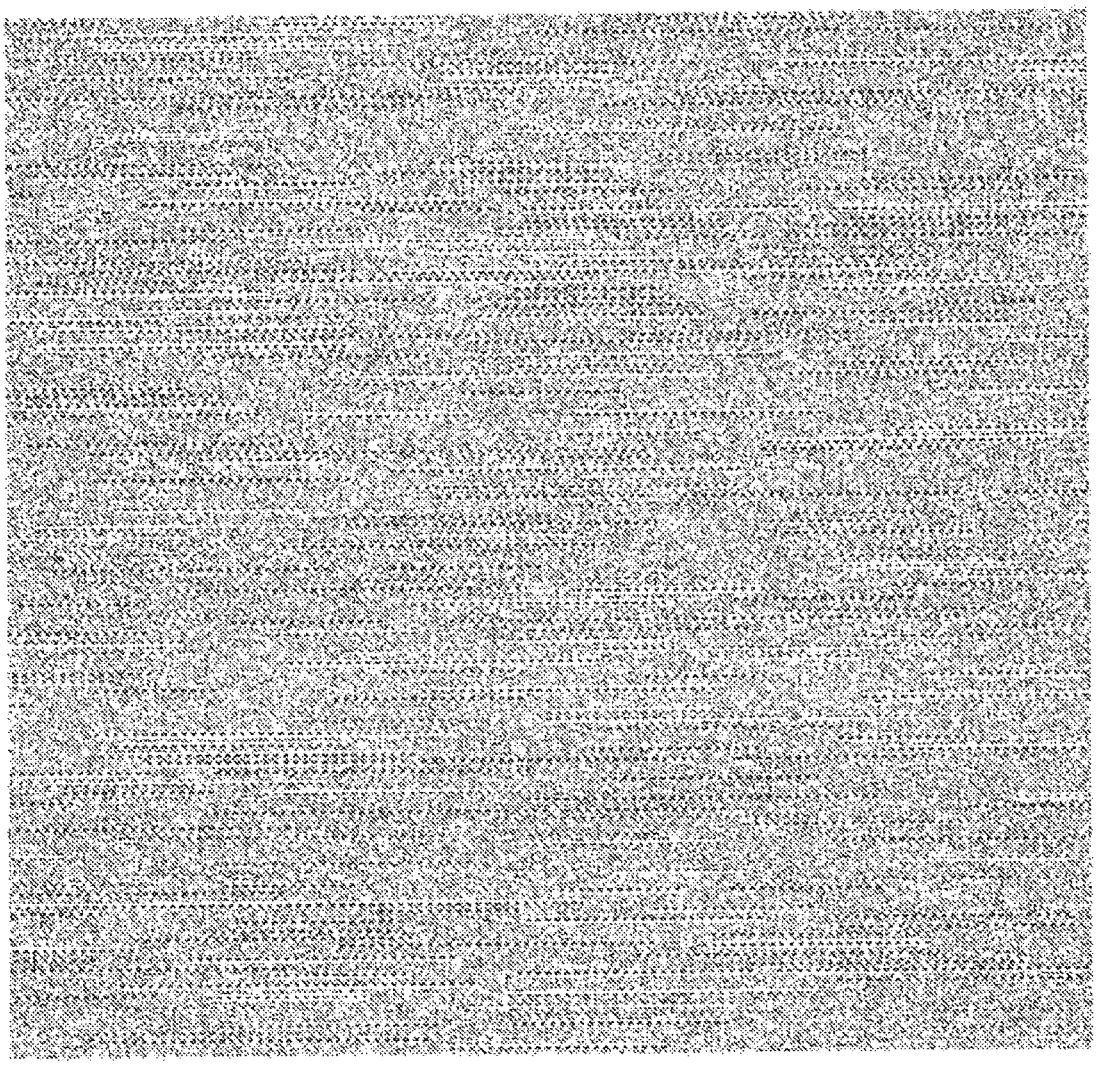
FIG. 24 illustrates an exemplary pattern generated for processing a surface of a fabric according to an exemplary embodiment.
Figure 25:
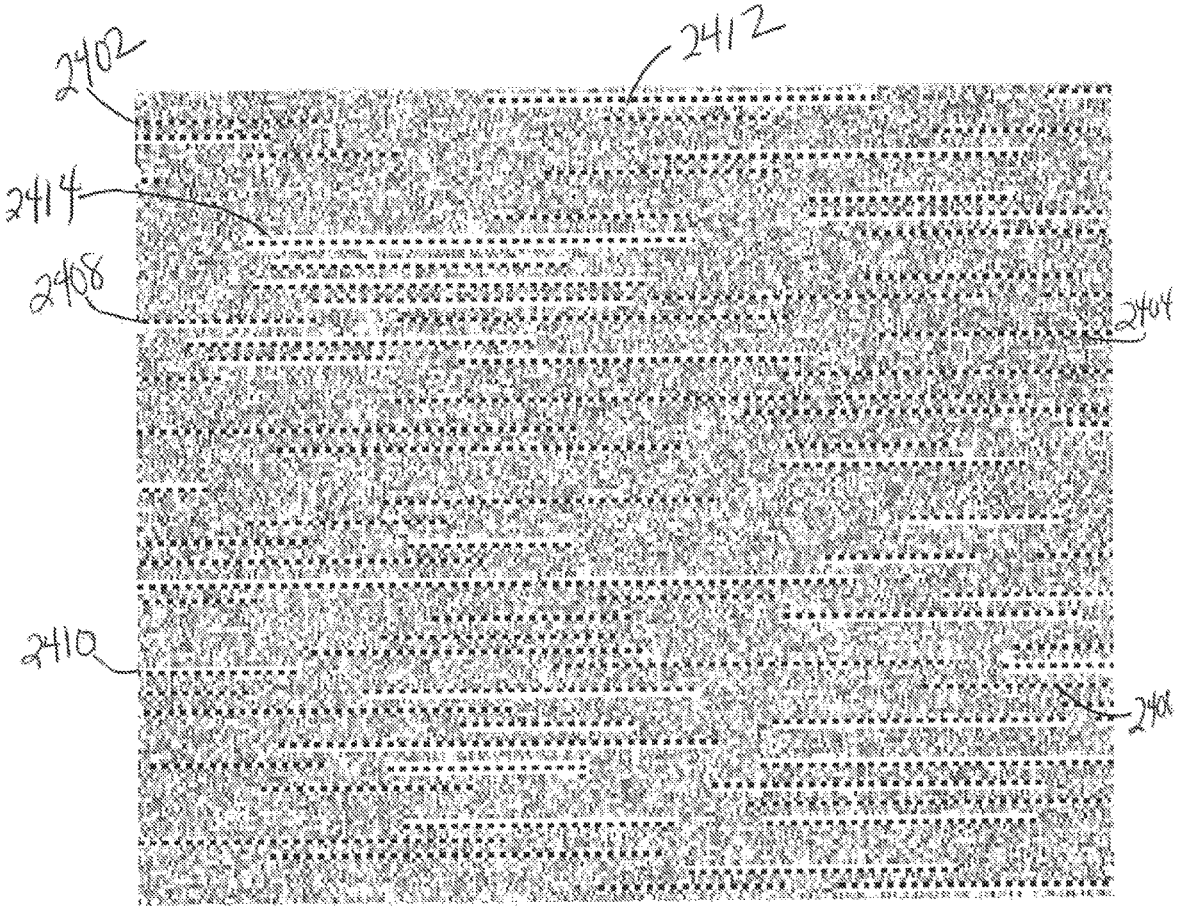
FIG. 25 illustrates a magnified portion of the exemplary pattern illustrated in FIG. 24.
Figure 26:
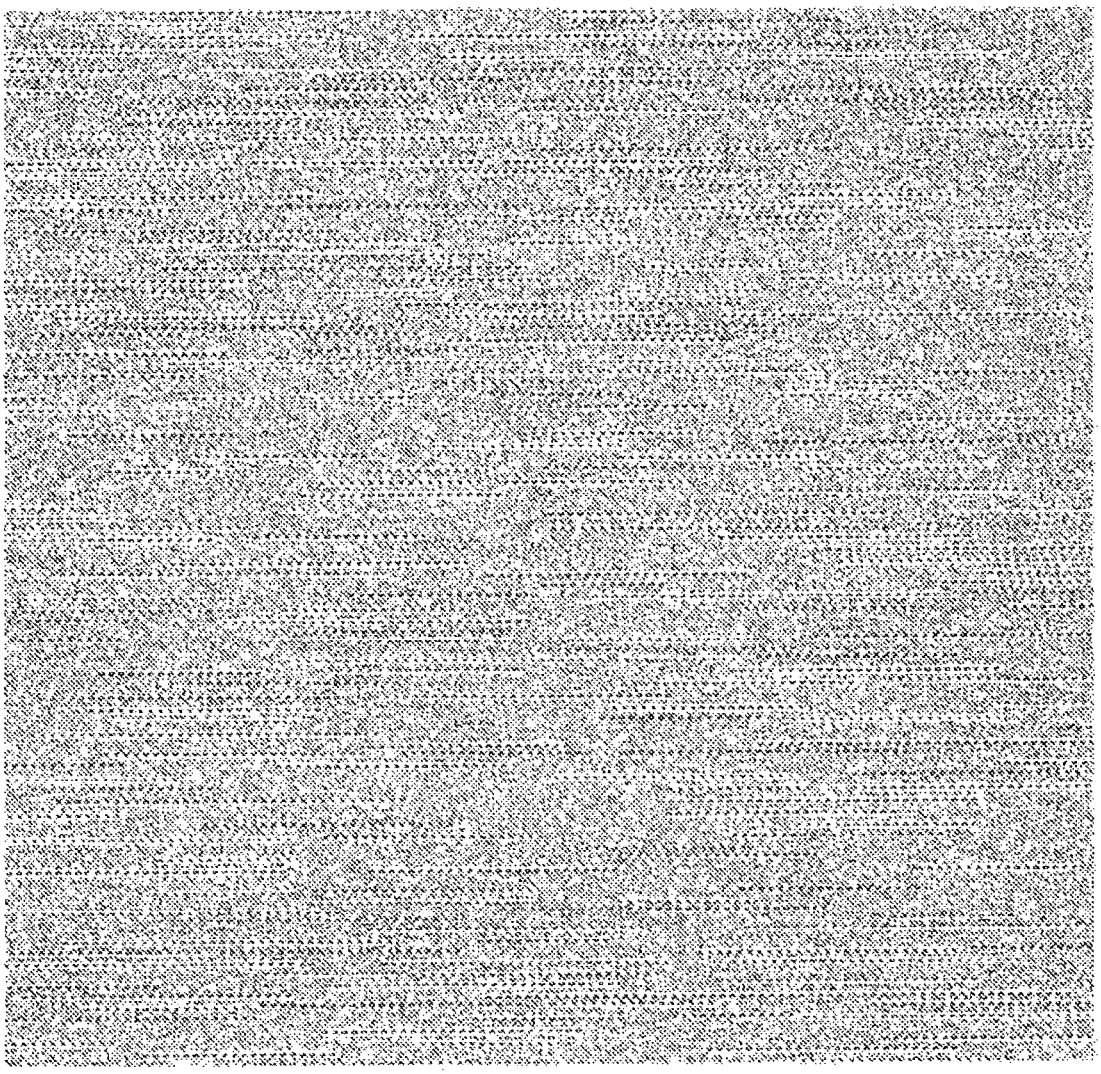
FIG. 26 illustrates another exemplary pattern generated for processing a surface of a fabric according to an exemplary embodiment.
Figure 27:
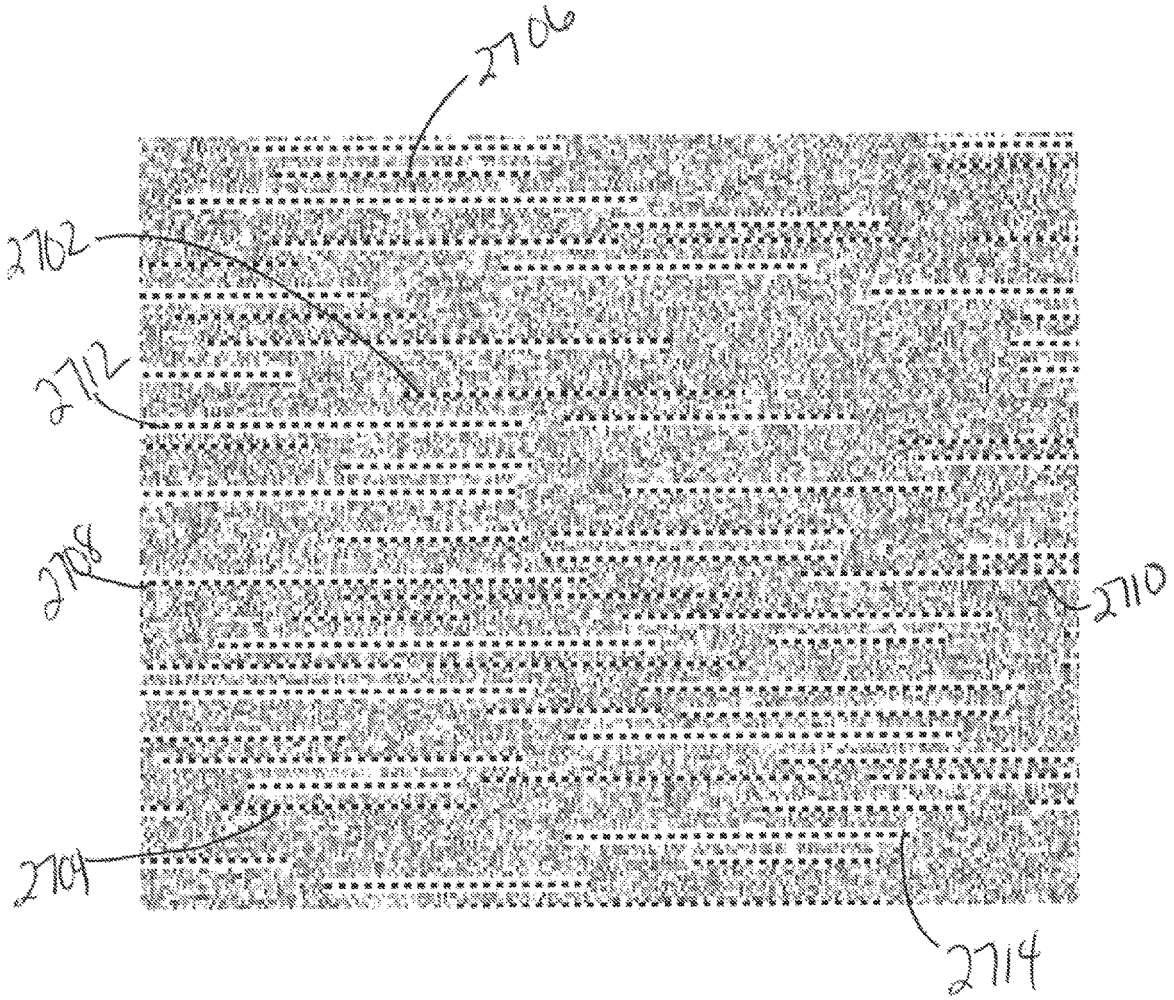
FIG. 27 illustrates a magnified portion of the exemplary pattern illustrated in FIG. 26.
Figure 28:
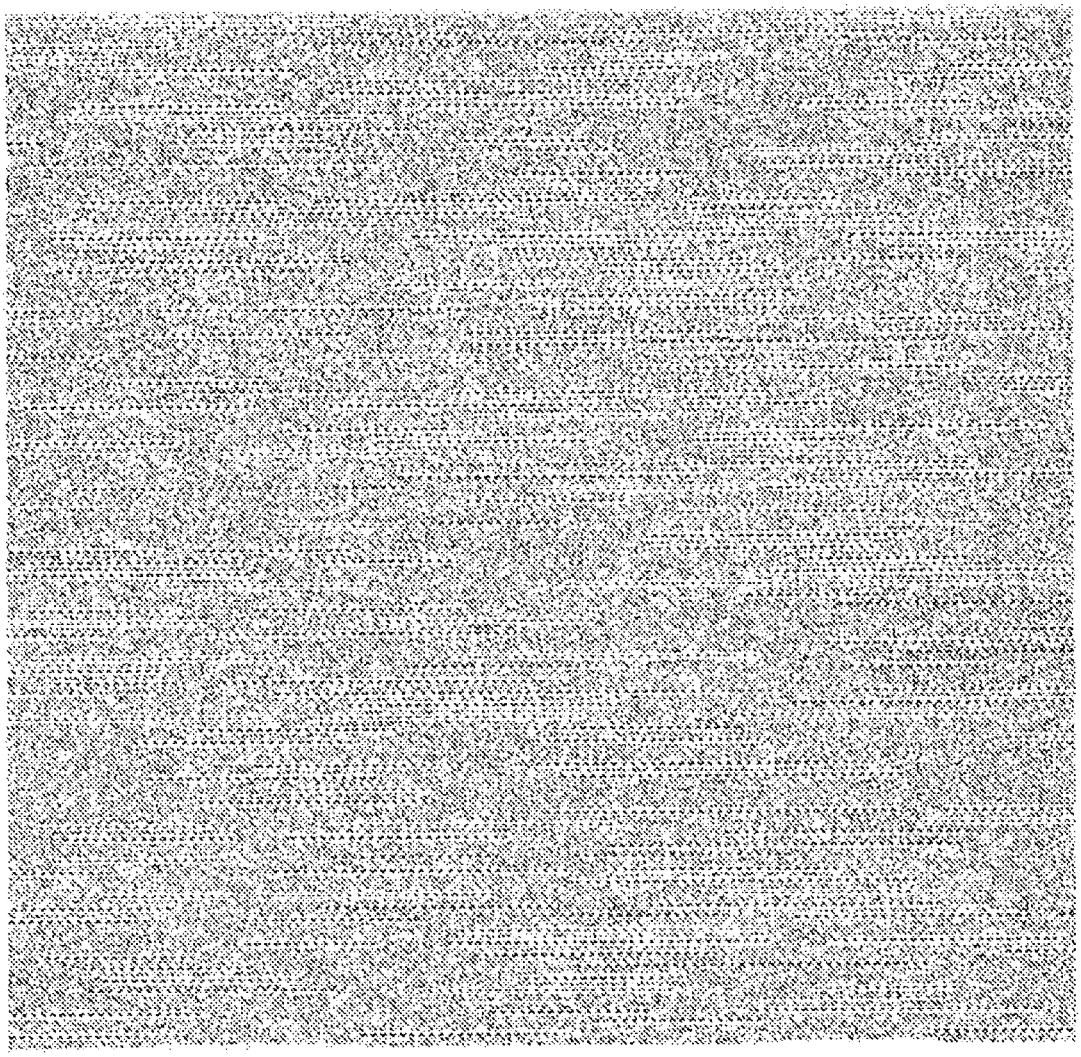
FIG. 28 illustrates another exemplary pattern generated for processing a surface of a fabric according to an exemplary embodiment.
Figure 29:
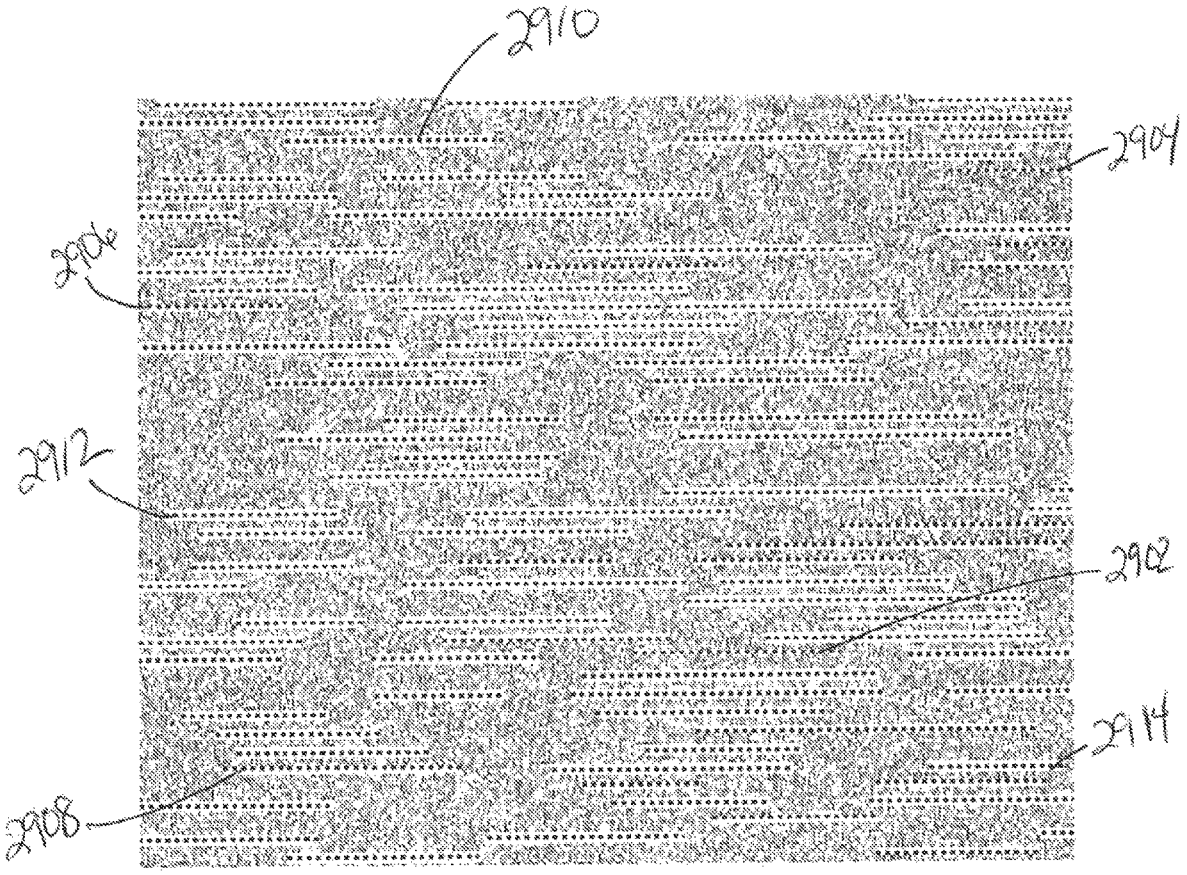
FIG. 29 illustrates a magnified portion of the exemplary pattern illustrated in FIG. 28.

A probability value can be defined such that the border parameters and density are randomly assigned. For example, FIG. 24 illustrates a portion of an exemplary pattern area where a border parameter with a probability of 30% is defined with respect to the second laser irradiation units, FIG. 26 illustrates a portion of an exemplary pattern area having a border parameter with a probability of 60%, and FIG. 28 illustrates a portion of an exemplary pattern area having a border parameter with a probability of 90%. All other parameters with respect to the first and second laser irradiation patterns remained the same. As best illustrated in FIG. 25, a magnified portion of the pattern area of FIG. 24 illustrates a number of second laser irradiation units that include no border (e.g., 2402, 2404, 2406) or a partial border where a solid border is provided on one side of a second laser irradiation unit (e.g., 2408, 2410). Moreover, FIG. 25 illustrates a few second laser irradiation units that include a full border around a second laser irradiation unit (e.g., 2412, 2414). FIG. 27 illustrates a magnified portion of the pattern area of FIG. 26 and includes a reduced number of second laser irradiation units that have no borders (e.g., 2702, 2704) with respect to the pattern illustrated in FIGS. 24 and 25. In addition, FIG. 27 further includes a greater number of second laser irradiation units that have a partial border (e.g., 2706, 2708, 2710) and a greater number of second laser irradiation units that have a full border (e.g., 2712, 2714). FIG. 29 illustrates a magnified portion of the pattern area of FIG. 28 and includes a reduced number of second laser irradiation units that have no border (e.g., 2902, 2904) or partial borders (e.g., 2906, 2908) with respect to the pattern illustrated in FIGS. 26 and 27. In addition, FIG. 29 further includes a greater number of second laser irradiation units that have a full border (e.g., 2910, 2912, 2914)

At 2208 in FIG. 22, the first laser irradiation pattern and the second laser irradiation pattern are arranged within the pattern area. The arrangement of the first laser irradiation pattern and the second laser irradiation pattern is based upon the parameters defined at 2204 and 2206. The first laser irradiation pattern can be merged with the second laser irradiation pattern, e.g., into the same file or as a single image on the graphic user interface. Alternatively, the first laser irradiation pattern and the second laser irradiation pattern can be formed consecutively, where either the first laser irradiation pattern or the second laser irradiation pattern may be formed first (e.g., multiple layers can be used to create a final pattern area where the first laser irradiation pattern is a first layer and the second laser irradiation pattern is a second layer processed separately).

Figure 30:
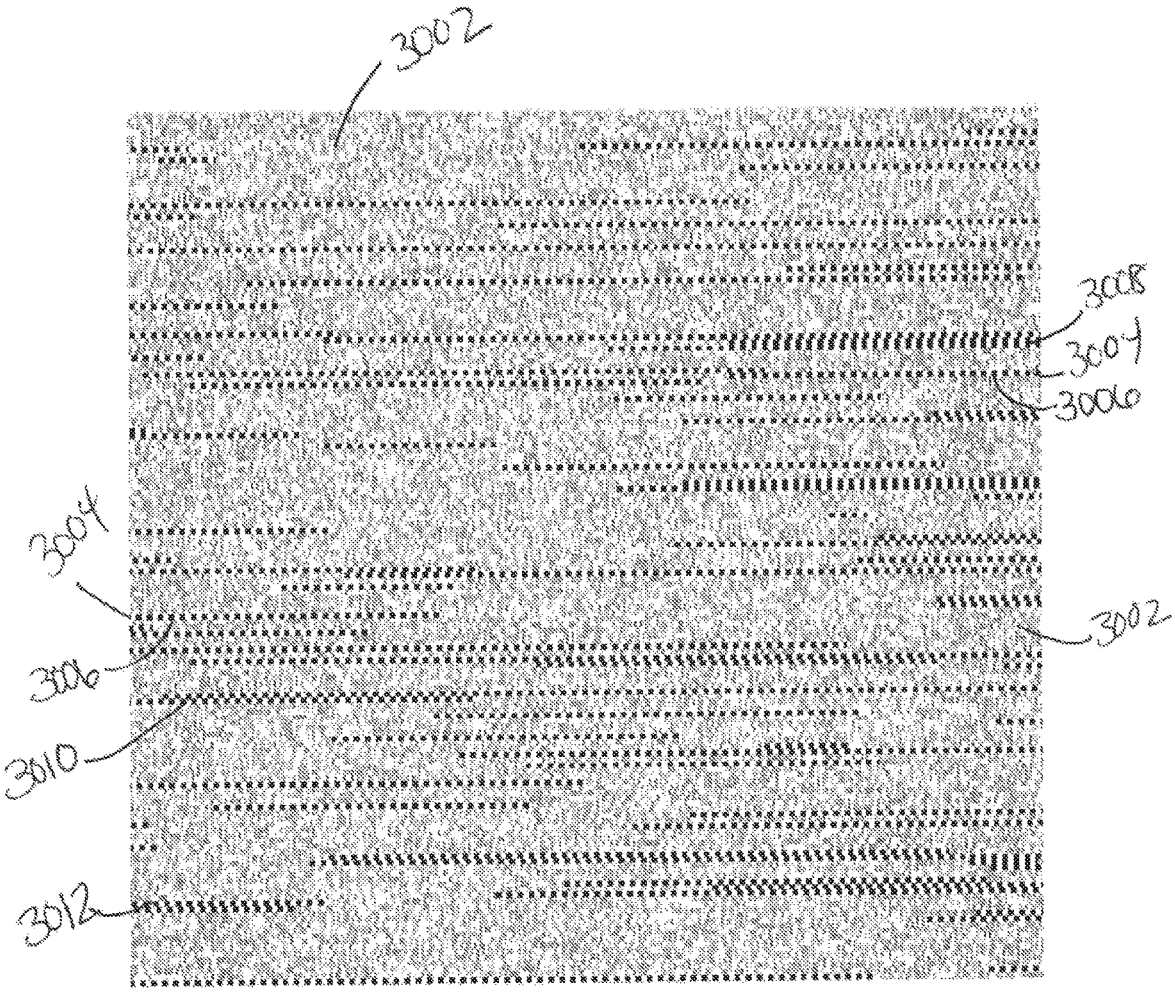
FIG. 30 illustrates a magnified portion of another exemplary pattern generated for processing a surface of a fabric according to an exemplary embodiment.

The first laser irradiation pattern and a second irradiation pattern are positioned within a pattern area such as illustrated in FIG. 30. The first laser irradiation pattern includes a plurality of first laser irradiation units 3002 formed at a first density and the second laser irradiation pattern includes a plurality of second irradiation units 3004 formed at a second density wherein each of the plurality of second irradiation units 3004 includes discontinuity elements 3006. For example, the second laser irradiation units can be selected to represent the maximum color intensity value (e.g., 0 or black) and the discontinuity elements can be selected to represent the minimum color intensity value (e.g., 255 or white) which results in a processed article where the second laser irradiation units are processed by the laser and the discontinuity elements are processed at a minimum value where the discontinuity elements are more visibly discernable due to the maximum laser processing of the fabric surrounding the discontinuity elements.

As illustrated in FIG. 30, the parameters associated with the number of consecutive pixels within the second laser irradiation unit (e.g., black pixels) has been defined to be two pixels and number of consecutive pixels associated with the discontinuity element (e.g., white pixels) has been defined as two pixels. When the second laser irradiation units are arranged within the pattern area, the second laser irradiation units in directly adjacent rows can be aligned in various arrangements. For example, the discontinuity elements can be directly aligned between second laser irradiation units (e.g., 3008), the discontinuity elements can be alternately aligned such as between second laser irradiation units (e.g., 3010), or the discontinuity elements can be partially aligned with the adjacent units such as between second laser irradiation units (e.g., 3012).

It is noted that the grayscale color levels of the first laser irradiation pattern 3002 are different than the grayscale color levels of the second laser irradiation pattern 3004 illustrated in FIG. 30. Specifically, the first laser irradiation pattern 3002 includes varying levels of grayscale such that the highest grayscale value used is less than the maximum color value (e.g. black) while the second laser irradiation pattern 3004 uses the minimum color value (e.g., white) and the maximum color value (e.g., black). However, it is noted that the first laser irradiation pattern and the second laser irradiation pattern can include any or all of the different color intensity levels defined.

At 2210, the dye removal parameters are input. For example, an energy level of a laser can be identified for each dye removal parameter represented within the plurality of first laser irradiation units and the plurality of second laser irradiation units. In an exemplary embodiment, the dye removal parameter of each different laser irradiation unit corresponds to a single color or color intensity. The energy level correlates to properties of the laser beam at the point at which the laser beam impinges upon the fabric to be processed through laser irradiation. In other words, an increase in applied power causes more dye removal, producing a lighter fabric area.

A user can individually input the dye removal parameter for each laser irradiation unit or each type of laser irradiation unit at the pattern generation interface of the pattern generating device 102. The dye removal parameter may be entered as, for example, a grayscale value (or range of values), a color intensity value (or range of values), as colors, etc. The pattern generating device 102 and/or control device 104 can automatically correlate a power level to each laser irradiation unit or each type of laser irradiation unit. The correlation between the power of the laser and the laser irradiation units can be done in various ways. For example, the different powers of the laser can be stored as a look up table where a specific laser irradiation unit indicator level (e.g., grayscale value or color intensity) is defined to be a specific power level.

Figure 17:
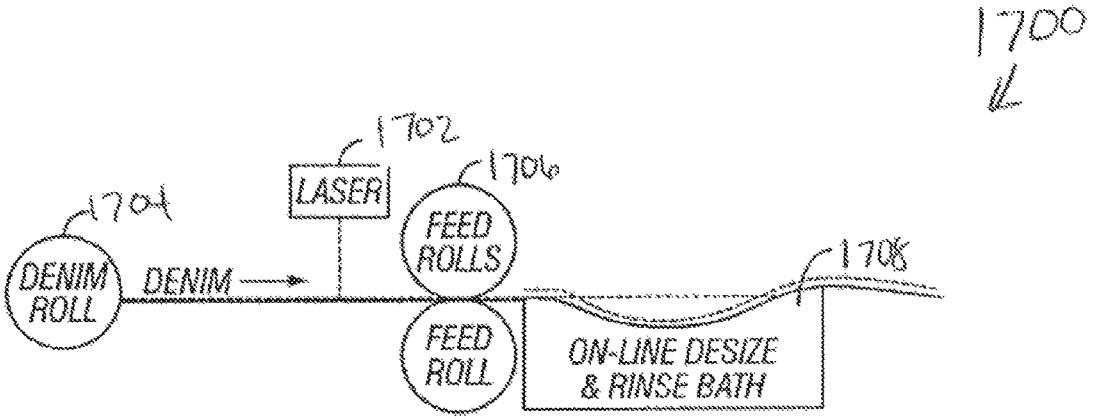
FIG. 17 illustrates a system for processing a surface of a fabric according to an exemplary embodiment.

The above-described methods of generating a pattern used to process a surface of a fabric through laser irradiation can be used in various laser processing systems. For example, as illustrated in FIG. 17, system 1700 includes a laser 1702 used to irradiate a surface of the fabric based on the generated pattern, where laser 1702 is mounted over a cutting table and one or more lasers forming system 1702 can scribe the patterns onto the fabric. When a plurality of lasers is implemented, one or more lasers can translate across the width of the denim roll or one or more lasers can translate along the machine direction (e.g., in the direction of the length of the denim). Specifically, the fabric can be fed onto the cutting table from a denim roll 1704 using feed rolls 1706. In one embodiment, no further processing is necessary. Further, one laser may irradiate the pattern across the width of the roll, or a plurality of lasers may be provided, with each laser irradiating one layer of a multiple layer image.

In another exemplary embodiment, the fabric can be further processed or washed using a rinse. For example, the fabric can be exposed to a conventional residential laundering process using a washing machine and detergent. Alternatively, the processed fabric can be further processed using a desizing agent or enzyme rinse. Specifically, the fabric can be washed in the on-line desize and rinse bath 1708. In an alternative embodiment, the fabric can be separately washed after assembly of the garment made using the fabric where the garment can include jeans, jackets, caps, etc. Implementation of the invention has the desired effect of minimizing if not eliminating a need to launder or otherwise wet process the lased fabric.

In an exemplary embodiment, the method of processing a surface of a fabric through laser irradiation can create a fabric where the fabric is made of a woven material (such as denim). The woven material can include a plurality of yarns. Because the laser impinges upon an exposed surface of the woven material, the dye on the yarns associated with that surface are modified. Other surfaces of the woven fabric, and other threads not exposed to laser irradiation retain the original color of the fabric. In other words, in dry processing techniques, after the fabric is processed to include an image associated with a pattern generated as described above, only the surface on which the laser impinges is processed. The surface of the fabric that is not exposed to laser irradiation remains unchanged and no processing is present within that surface. In contrast, wet processing techniques treat both sides of the fabric such that a change in mechanical and/or chemical properties is introduced to each side of the fabric.

Figure 18:
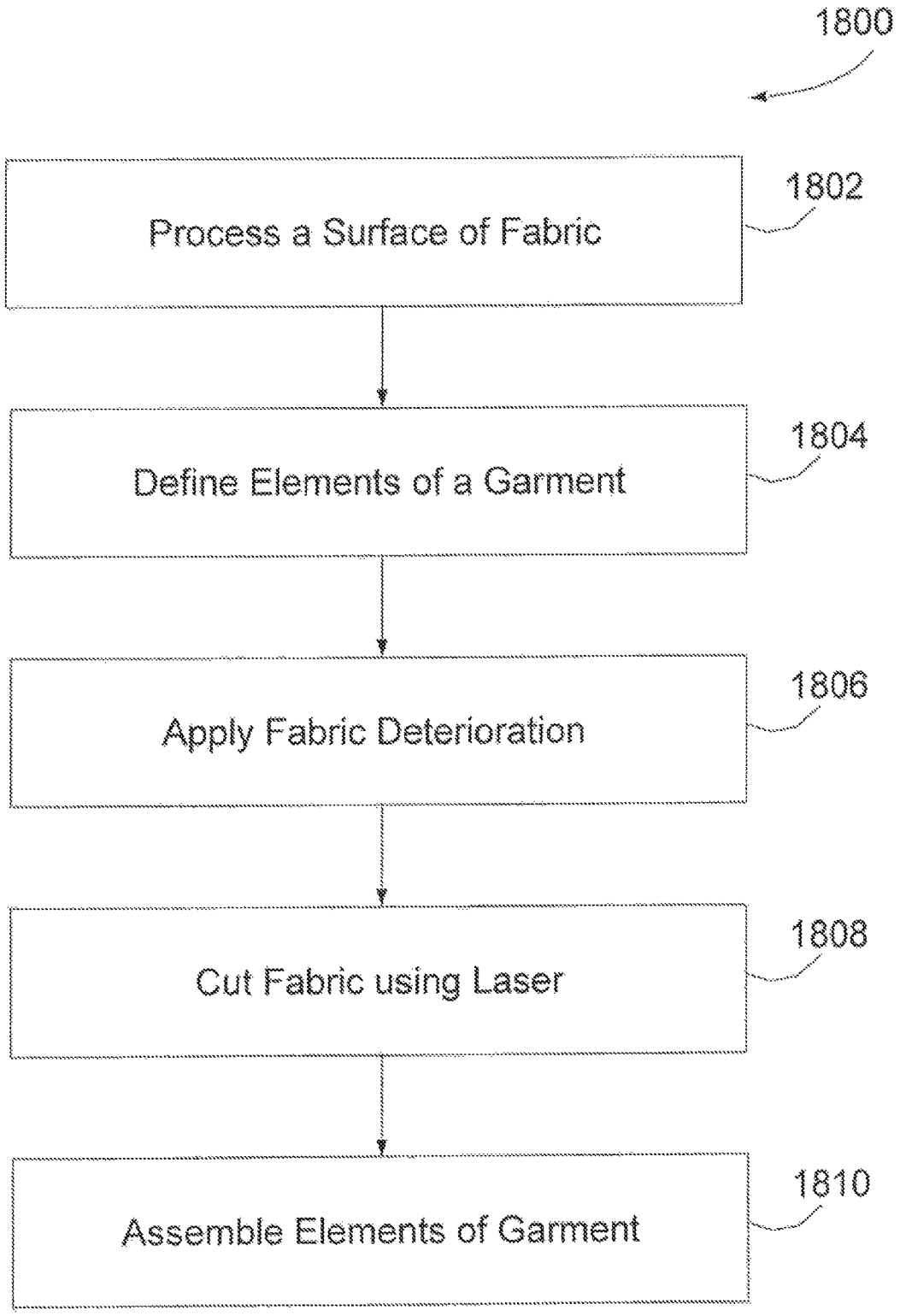
FIG. 18 illustrates a flow chart of an exemplary method of manufacturing a garment according to an exemplary embodiment.

FIG. 18 illustrates a flow chart of an exemplary method 1800 for manufacturing a garment from a fabric where the fabric includes a surface processed using laser irradiation. The method will be discussed with reference to the exemplary system 100 and 1700 illustrated in FIGS. 1 and 17. However, the method can be implemented with any suitable system. In addition, although FIG. 18 depicts steps performed in a particular order for purposes of illustration and discussion, the methods discussed herein are not limited to any particular order or arrangement. One skilled in the art, using the disclosures provided herein, will appreciate that various steps of the methods can be omitted, rearranged, combined, and/or adapted in various ways.

At 1802, a pattern is generated at a pattern generation device. For example, a photo-deterioration pattern (e.g., a pattern that when applied to the surface of a fabric reduces the level of dye intensity and/or modifies the tensile and tear properties of the fabric) such as one described above can be generated at pattern generation device 102. Alternatively or in addition to the photo-deterioration pattern, a material deterioration process can be generated such as an abrasion technique simulating sandblasting or hand sanding that, when applied to the fabric, creates the desirable "worn look" by modifying the tensile and tear properties of the fabric. It is noted that the material deterioration process affects the tensile and tear properties more than the photo-deterioration technique.

Figure 19:
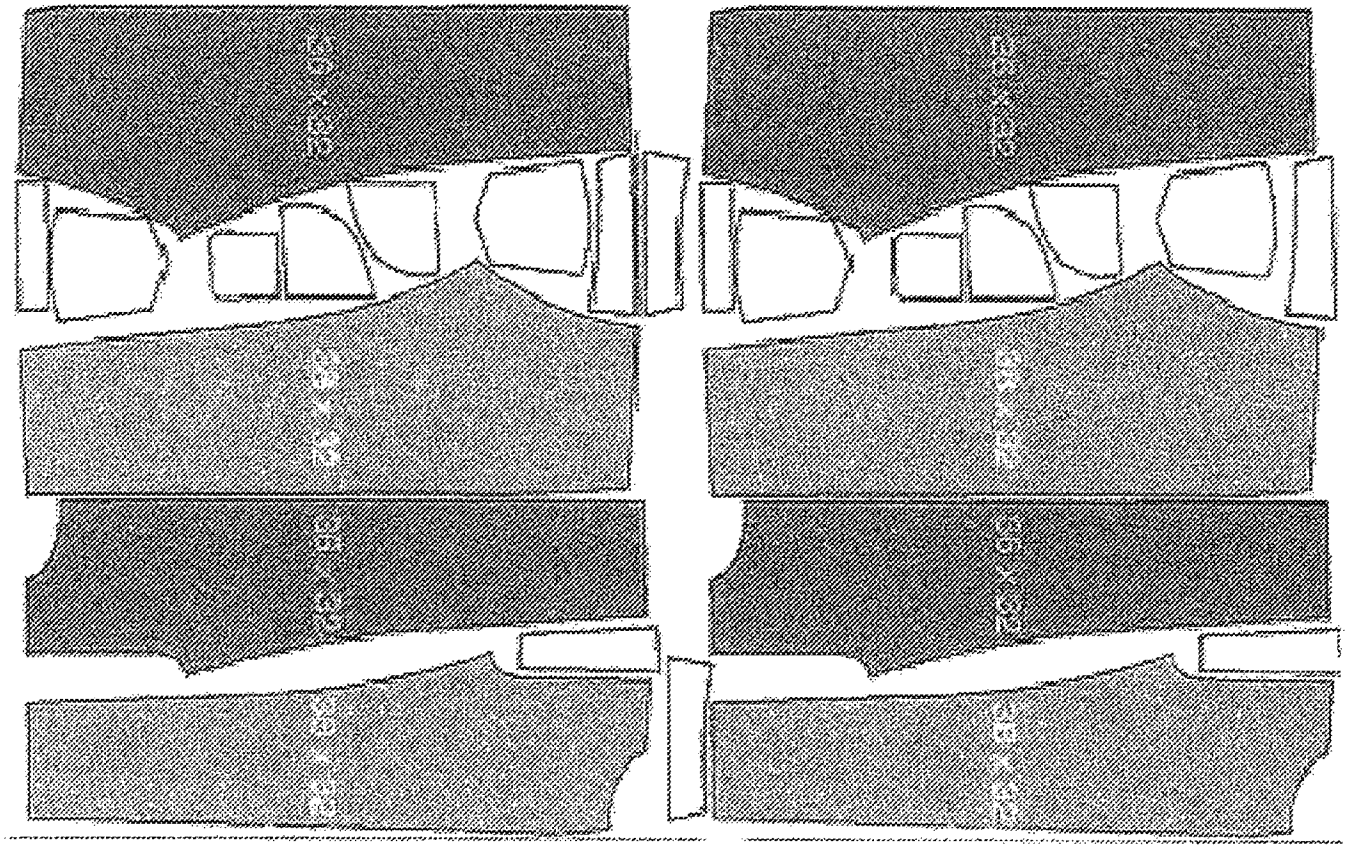
FIGS. 19 and 20 illustrate exemplary markers used in an exemplary method of manufacturing a garment according to an exemplary embodiment.
Figure 20:
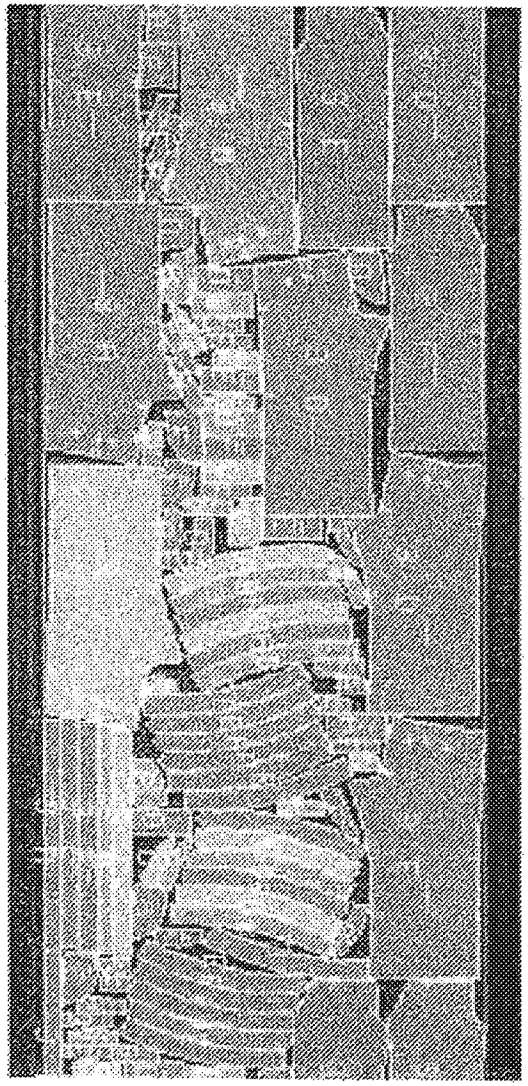

A layout of garment elements is defined at 1804. For example, markers or templates can be created where each marker or template is associated with each element of the garment. The markers are arranged to correspond to the fabric. This arrangement can be done using a physical marker or creating an arrangement virtually within a software program. Exemplary layouts are illustrated in FIGS. 19 and 20.

At 1806, a pattern is applied to the surface of the fabric. For example, after the markers are arranged with respect to the fabric to simulate the placement of each garment element, at least one of the photo-deterioration pattern and/or the material deterioration pattern is applied to the surface of the fabric associated with the garment element. In an exemplary embodiment, the photo-deterioration pattern and/or the material deterioration pattern can be integrated into the marker or template or it can be a separate image file. Each marker can include a graphic and/or a photo-deterioration pattern and/or a material deterioration pattern. The graphic, photo-deterioration pattern, and/or the material deterioration pattern may be arranged within the entire marker. Alternatively, the graphic, photo-deterioration pattern, and/or the material deterioration pattern may be arranged to prevent additional processing in the portions of the markers associated with the seaming areas of the final garment. For example, a border or edge portion, such as approximately 0.6 inches, can be defined around the edges of each marker where the defined border or edge results in untreated areas for the seaming process. Alternatively, the border or edge portion can be defined to include a pattern associated with a seam abrasion look such that additional processing can be reduced after the garment is assembled. Additionally, the border may be appear to replicate stitching, such as is used to conventionally used to interconnect garment pieces. Frequently, the stitching is a color different than the fabric color and the invention allows stitching to be replicated or simulated by appropriate selection of the imaging techniques herein disclosed.

In addition to the photo-deterioration pattern and/or the material deterioration pattern, other patterns can be applied to the surface of the fabric such as lines indicating where the elements are to be sewn during assembly, alignment indicators, other markings, etc.

One or more lasers can be used to apply the pattern to the surface of the fabric. For example, one laser can be used to apply both the photo-deterioration pattern and the material deterioration pattern. In another example, one or more lasers can be used to apply the photo-deterioration pattern and one or more other lasers can be used to apply the material deterioration pattern.

The garment elements can be cut from the fabric at 1808. For example, each element which has already been processed to include any desired photo-deterioration and/or material deterioration can be cut from the fabric. The elements can be cut from the fabric using the laser or another laser downstream of the laser applying the image, or alternative mechanical cutting tools may be used. When the elements are cut using a laser, the laser used to cut the fabric can be the same laser or a different laser from the laser used to apply the pattern to the surface of the fabric. In an exemplary embodiment, a plurality of layers of fabric can be stacked on top of each other on the cutting table prior to cutting the elements from the fabric. An alignment indicator can be used to assure that each layer is properly aligned prior to cutting. For example, the alignment indicator can be a visual indicator visible on the surface of the fabric. Alternatively, the alignment indicator can be a hole formed in the fabric wherein an alignment member such as a dowel can be inserted within the hole in each fabric layer to align the layers prior to cutting.

At 1810, the elements of the garment are assembled. In an exemplary embodiment, the resulting garment can be further processed using a wet processing technique such as laundering, enzyme and stone wash, etc. While we prefer that the dye modification techniques disclosed herein be applied to a roll of fabric, those skilled in the art will recognize that the laser irradiation to create a photo-deterioration pattern may be directed to the fabric on the roll, on garment components after being cut from an untreated roll, or to the finished garment.

The foregoing detailed description of the certain exemplary embodiments has been provided for the purpose of explaining the principles of the invention and its practical application, thereby enabling others skilled in the art to understand the invention for various embodiments and with various modifications as are suited to the particular use contemplated. This description is not necessarily intended to be exhaustive or to limit the invention to the precise embodiments disclosed. The specification describes specific examples to accomplish a more general goal that may be accomplished in another way.

What is claimed is:

1. A method of generating a pattern image on a pattern area of a user interface, the pattern area comprising an array of pixels, the pattern image being useful to form a corresponding pattern on a surface of a fabric by application of laser irradiation, the method comprising:

inputting a plurality of parameters associated with laser irradiation units into the user interface, the plurality of parameters comprising an area parameter comprising a width and a length, wherein the length is greater than the width, a laser irradiation unit density parameter, a discontinuity parameter comprising a skip between the laser irradiation units, a gap within the laser irradiation units, and/or a laser frequency effective for generating discontinuities in the corresponding pattern lased onto the surface of the fabric, and a dye removal parameter representing an amount of dye to be removed from the fabric, the amount of dye to be removed being subject to laser operational settings; and viewing the laser irradiation units arranged in the pattern area of the user interface based on computer processing of the inputted plurality of parameters, the laser irradiation units collectively establishing the pattern image for viewing.

2. The method of claim 1, wherein said inputting of the area parameter comprises inputting a minimum width value, a maximum width value, a minimum length value, and a maximum length value.

3. The method of claim 1, wherein said inputting of the laser irradiation unit density parameter comprises inputting a probability value correlating to a probability of a pixel of the array of pixels within the pattern area being selected for one of the laser irradiation units.

4. The method of claim 1, wherein said inputting of the discontinuity parameter comprises inputting a gap value representing a number or range of numbers of pixels consecutively off, within the laser irradiation units and inputting a pixels-on value representing a number or range of numbers of pixels consecutively on within the laser irradiation units, wherein the pixels consecutively on alternate with the pixels consecutively off.

5. The method of claim 1, wherein said inputting of the dye removal parameter comprises inputting a minimum grayscale value and a maximum grayscale value, a minimum color intensity value and a maximum color intensity value, or different colors representing respective dye removal values.

6. The method of claim 1, wherein the laser irradiation units are linear in shape, wherein the width comprises a maximum width corresponding to at most three of the pixels, and wherein the length is at least twice as great as the maximum width.

7. The method of claim 1, wherein the pattern image simulates an appearance of a ring spun pattern.

8. The method of claim 1, further comprising:

inputting a plurality of second parameters associated with second laser irradiation units into the user interface, the plurality of second parameters comprising a second area parameter comprising a second width and a second length, wherein the second length is greater than the second width, a second laser irradiation unit density parameter, a second discontinuity parameter comprising a second skip between the second laser irradiation units, a second gap within the second laser irradiation units, and/or a second laser frequency effective for generating second discontinuities in the corresponding pattern lased onto the surface of the fabric, and a second dye removal parameter representing a second amount of dye to be removed from the fabric; and wherein said viewing further comprises viewing the second laser irradiation units arranged in the pattern area of the user interface based on the inputted plurality of second parameters, the laser irradiation units and the second laser irradiation units collectively establishing the pattern image for viewing.

9. The method of claim 1, further comprising:

inputting a plurality of second parameters associated with second laser irradiation units into the user interface, the plurality of second parameters comprising a second area parameter comprising a second width of at least one pixel and a second length of at least one pixel, a second laser irradiation unit density parameter, a second dye removal parameter representing a second amount of dye to be removed from the fabric; and wherein said viewing further comprises viewing the second laser irradiation units arranged in the pattern area of the user interface based on the inputted plurality of second parameters, the laser irradiation units and the second laser irradiation units collectively establishing the pattern image for viewing.

10. A method of lasing a surface of a fabric using laser irradiation, comprising:

generating a pattern image according to the method of claim 1; and causing the pattern image or machine-readable language representing the pattern image to be transmitted to a laser for lasing a pattern corresponding to the pattern image onto the surface of the fabric.

11. The method of claim 10, further comprising:

providing a plurality of lasers, at least a first laser of the plurality of lasers being operable to lase the corresponding pattern onto the surface of the fabric and at least a second laser of the plurality of lasers being operable to cut through at least a portion of the thickness of the fabric.

12. A system for generating a pattern image used to lase a corresponding pattern onto a surface of a fabric using laser irradiation, the system comprising:

a pattern generating device configured to receive a plurality of parameters associated with laser irradiation units inputted into a user interface, the plurality of parameters comprising an area parameter comprising a width and a length, wherein the length is greater than the width, a laser irradiation unit density parameter, a discontinuity parameter comprising a skip between the laser irradiation units, a gap within the laser irradiation units, and/or a laser frequency effective for generating discontinuities in the corresponding pattern lased onto the surface of the fabric, and a dye removal parameter representing an amount of dye to be removed from the fabric, the amount of dye to be removed being subject to laser operational settings; and arrange the laser irradiation units in the pattern area of the user interface based on computer processing of the inputted plurality of parameters, the laser irradiation units collectively establishing the pattern image for viewing of the corresponding pattern to be lased onto the surface of the fabric.

13. A method of generating a pattern image on a pattern area of a user interface, the pattern area comprising an array of pixels, the pattern image being useful to form a corresponding pattern on a surface of a fabric by application of laser irradiation, comprising:

inputting a plurality of parameters associated with laser irradiation units into the user interface, the plurality of parameters comprising an area parameter comprising a width of at least one pixel and a length of at least one pixel, a laser irradiation unit density parameter, and a dye removal parameter representing an amount of dye to be removed from the fabric, the amount of dye to be removed being subject to laser operational settings; and viewing the laser irradiation units arranged in the pattern area of the user interface based on computer processing of the inputted plurality of parameters, the laser irradiation units collectively establishing the pattern image for viewing.

14. The method of claim 13, wherein said inputting of the area parameter comprises inputting a minimum width value, a maximum width value, a minimum length value, and a maximum length value.

15. The method of claim 13, wherein the width and the length are equal to one another.

16. The method of claim 13, wherein said inputting of the laser irradiation unit density parameter comprises inputting a probability value correlating to a probability of a pixel of the array of pixels within the pattern area being selected for one of the laser irradiation units.

17. The method of claim 13, wherein said inputting of the dye removal parameter comprises inputting a minimum grayscale value and a maximum grayscale value, a minimum color intensity value and a maximum color intensity value, or different colors representing respective dye removal values.

18. The method of claim 13, wherein the pattern image simulates an appearance of a stone washed or enzyme pattern.

19. The method of claim 13, further comprising:

inputting a plurality of second parameters associated with second laser irradiation units into the user interface, the plurality of second parameters comprising a second area parameter comprising a second width of at least one pixel and a second length of at least one pixel, a second laser irradiation unit density parameter, a second dye removal parameter representing a second amount of dye to be removed from the fabric; and wherein said viewing further comprises viewing the second laser irradiation units arranged in the pattern area of the user interface based on computer processing of the inputted plurality of second parameters, the laser irradiation units and the second laser irradiation units collectively establishing the pattern image for viewing.

20. A method of lasing a surface of a fabric using laser irradiation, comprising:

generating a pattern image according to the method of claim 13; and causing the pattern image or machine-readable language representing the pattern image to be transmitted to a laser for lasing a pattern corresponding to the pattern image onto the surface of the fabric.

21. The method of claim 20, further comprising:

providing a plurality of lasers, at least a first laser of the plurality of lasers being operable to lase the corresponding pattern onto the surface of the fabric and at least a second laser of the plurality of lasers being operable to cut through at least a portion of the thickness of the fabric.

22. A system for generating a pattern image used to lase a corresponding pattern onto a surface of a fabric using laser irradiation, the system comprising:

a pattern generating device configured to receive a plurality of parameters associated with laser irradiation units inputted into a user interface, the plurality of parameters comprising an area parameter comprising a width of at least one pixel and a length of at least one pixel, a laser irradiation unit density parameter, and a dye removal parameter representing an amount of dye to be removed from the fabric, the amount of dye to be removed being subject to laser operational settings; and arrange the laser irradiation units in the pattern area of the user interface based on computer processing of the inputted plurality of parameters, the laser irradiation units collectively establishing the pattern image for viewing of the corresponding pattern to be lased onto the surface of the fabric.

* * * * *